US005699655A

United States Patent [19]

Kuboyama et al.

[11] Patent Number: 5,699,655

[45] Date of Patent: Dec. 23, 1997

[54] FOOD MATERIAL TRANSFERRING APPARATUS

[75] Inventors: Kimimasa Kuboyama; Shoji Yokoyama; Yoshinori Miyakoshi; Hiroya Taniguchi, all of Tokyo; Kazuhiro Tsuruta; Hisashi Goto, both of Mie, all of Japan

[73] Assignee: Fuji Electric Co., Ltd., Kawasaki, Japan

[21] Appl. No.: 566,178

[22] Filed: Dec. 1, 1995

[30] Foreign Application Priority Data

| | | | |
|---|---|---|---|
| Dec. 5, 1994 | [JP] | Japan | 6-300471 |
| Jan. 11, 1995 | [JP] | Japan | 7-002359 |
| Jun. 15, 1995 | [JP] | Japan | 7-148573 |

[51] Int. Cl.[6] ..... B65B 35/50

[52] U.S. Cl. ..... 53/540; 53/116; 53/120; 53/127; 53/154; 53/228; 53/504; 99/450.2; 99/450.7

[58] Field of Search ..... 53/116, 117, 120, 53/127, 154, 155, 228, 229, 51, 504, 540; 99/357, 483, 450.1, 450.2, 450.4, 450.6, 450.7

[56] References Cited

U.S. PATENT DOCUMENTS

| | | | |
|---|---|---|---|
| 4,084,493 | 4/1978 | Quintana | 99/450.6 X |
| 4,483,242 | 11/1984 | Goodman et al. | 99/450.7 X |
| 4,516,487 | 5/1985 | Madison et al. | 99/450.7 X |
| 4,608,919 | 9/1986 | Prows et al. | 99/450.2 X |
| 4,638,729 | 1/1987 | Woodworth et al. | 99/450.7 X |
| 5,263,407 | 11/1993 | Pomara, Jr. | 99/450.7 X |
| 5,328,709 | 7/1994 | Larsen | 99/450.7 X |
| 5,531,156 | 7/1996 | Brummett | 99/450.7 X |
| 5,551,333 | 9/1996 | Goto et al. | 99/450.6 |

*Primary Examiner*—Daniel Moon

*Attorney, Agent, or Firm*—Kanesaka & Takeuchi

[57] ABSTRACT

A food material transferring apparatus basically includes a heating device, a pushing member, and a tray. Food materials are placed on a tray, and inserted into the heating device. The heating device heats the food material, and the pushing member is driven to push the food material from the heating device while folding the food material. An arm is provided with a hand having absorption pads to be able to absorb the food material. The arm is attached to a bi-directional straight proceeding mechanism, which moves the hand in the vertical and horizontal directions, so that the food material is taken out from the tray and inserted into the heating device.

15 Claims, 17 Drawing Sheets

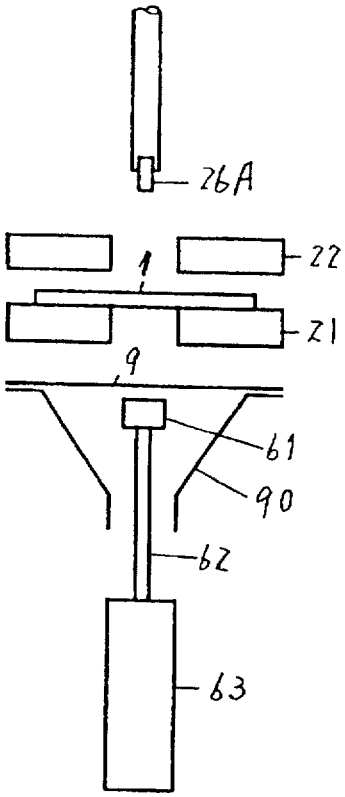
Fig. 17(a)
Fig. 17(b)
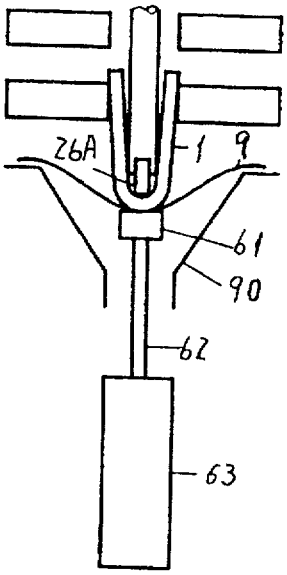
Fig. 17(c)
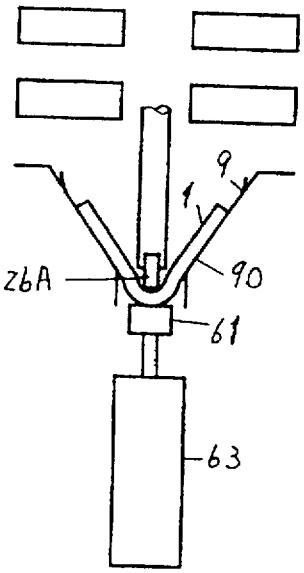

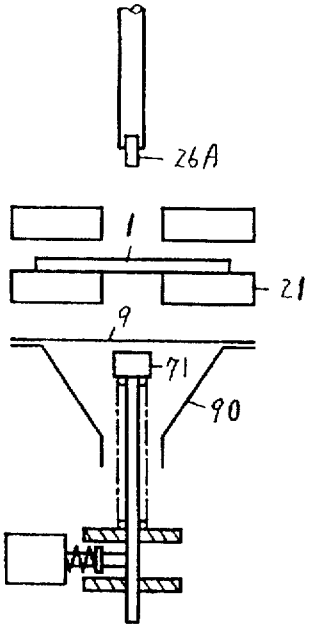
Fig. 19(a)
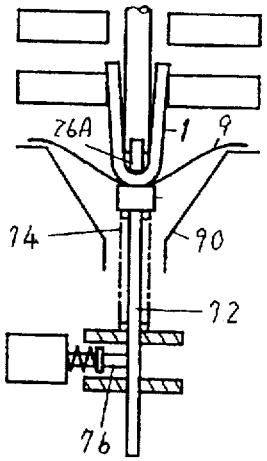
Fig. 19(b)
Fig. 19(c)
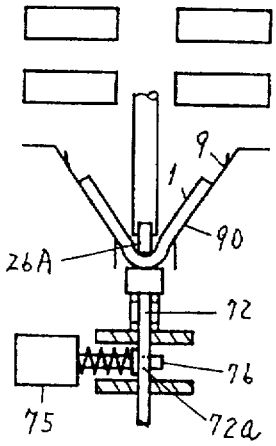
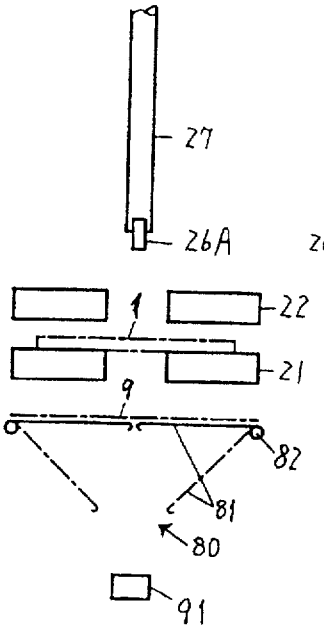
Fig. 20(a)
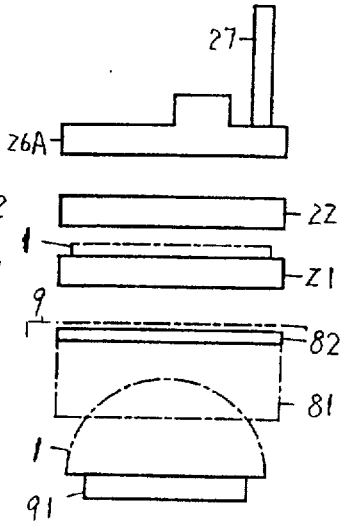
Fig. 20(b)

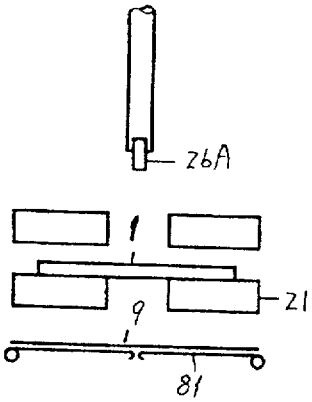
Fig. 21(a)
Fig. 21(b)
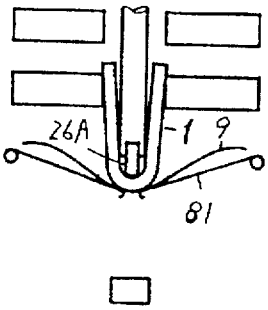
Fig. 21(c)
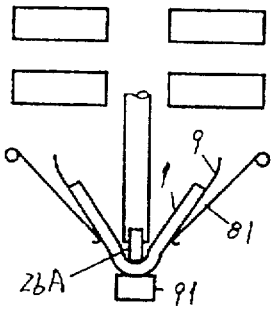
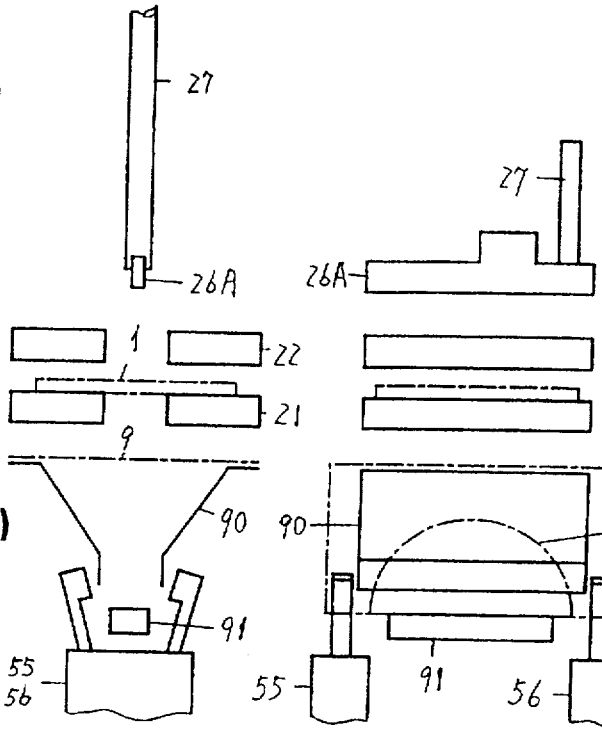
Fig. 22(a)
Prior Art
Fig. 22(b)
Prior Art

FOOD MATERIAL TRANSFERRING APPARATUS

BACKGROUND OF THE INVENTION AND RELATED ART STATEMENT

The present invention relates to a food material transferring apparatus, wherein basic materials of a soft circular shape food, such as a taco, a crepe, a pizza, or a Japanese pancake, laminated and stored on trays, are taken out one by one, heated in a heating device, and pushed downward while being folded into a V-shape.

Conventionally, in order to locate a food material, which is pushed downward after heated, in the vicinity of a front portion, a food material transferring apparatus has a structure, wherein trays for storing food materials are provided in plural levels at an upper part of the front portion, a heating device and a pushing device are disposed under the trays, and a mechanism for transferring the food materials is provided behind these devices. Consequently, the food materials are taken out from the trays one by one through a vacuum-absorbing hand of the transferring mechanism; inserted into and set in the heating device; heated therein; and then pushed downward by the pushing device.

In the above pushing step, the horizontally placed food material is pushed by a descending band plate shape pushing member to be laminated on a wrapping paper located under the food material; and pushed downward while folding the food material into a V-shape along a diameter thereof as a folding line. In this step, an auxiliary device is used for preventing a positioning deviation between the food material and the wrapping paper to thereby improve wrapping of the food material.

The conventional auxiliary device is explained hereinafter referring to FIGS. 22(*a*) and 22(*b*) and FIGS. 23(*a*) to 23(*c*). FIG. 22(*a*) is a front view of the conventional auxiliary device, and FIG. 22(*b*) is a side view thereof. In the drawings, a soft circular food material 1 (as shown by single dotted chain line) is placed on an upper surface of a fixed lower heating plate 21. An upper heating plate 22 which descends and ascends or vertically moves, is disposed above the lower heating plate 21. In FIG. 22(*a*), after the food material 1 is inserted between the lower and upper heating plates 21, 22 from a right side and then placed on a center of the upper surface of the lower heating plate 21, the upper heating plate 22 descends to press and heat the food material 1. After the upper heating plate 22 ascends to return to a position shown in the drawing, a band plate shape pushing member 26A disposed uprightly in a widthwise direction vertically moves through the upper and lower heating plates 22, 21. The upper and lower heating plates 22, 21 are provided with an unnumbered space respectively so that the pushing member 26A can pass therethrough. The pushing member 26A is provided to a lower edge of a pushing axis 27 which is a straight proceeding type output axis of an actuator (not shown in the drawings). A V-shaped guide 90 is disposed under the lower heating plate 21. The guide 90 is formed of plate-like members provided in a V-shape to be symmetrical on left and right sides, and upper end portions of both the members are bent outward to define a horizontal plane. On this horizontal plane, a square wrapping paper 9 for the food material 1 having an area slightly larger than the food material 1 and shown by a single dotted chain line, is placed. Under a lower opening of the guide 90, a square rod shape receiving table 91 is fixed.

In FIG. 22(*b*), under the lower opening of the guide 90, a holding member 55 and a holding-transferring member 56 are disposed in left and right sides. While the holding member 55 is fixed, the holding-transferring member 56 is structured to be horizontally reciprocated in arrow directions by one pitch, i.e. by a length corresponding to a width of the wrapping paper 9. As partly shown in FIG. 22(*a*), the holding member 55 and the holding-transferring member 56 are respectively formed of a pair of opening and closing type holding fingers.

Operations in a conventional embodiment of the auxiliary device are explained hereunder referring to FIGS. 23(*a*) to 23(*c*). FIGS. 23(*a*) to 23(*c*) relate to operation steps of the conventional embodiment of the auxiliary device, wherein FIG. 23(*a*) is a front view before a pushing operation, FIG. 23(*b*) is a front view in the middle of the pushing operation, and FIG. 23(*c*) is a front view after the pushing operation. In FIG. 23(*a*), the food material 1 is under a pressed and heated condition, and while the wrapping paper 9 is stored in a wound roll shape, through a feeding mechanism (not shown in the drawings), the wrapping paper 9 is fed from one side to the other side along the horizontal plane of the upper end of the guide 90, positioned right under the food material 1, and cut into a square wrapping unit. The wrapping paper 9 has a size to wrap the food material with enough room. Incidentally, at the beginning of the operation steps, the pushing member 26A is located above the upper heating plate 22.

In FIG. 23(*b*), as the pushing member 26A descends, firstly, the pushing member 26A passes through the space in the upper heating plate 22; pushes the food material 1 placed on the upper surface of the lower heating plate 21 through the space thereof; and then pushes the wrapping paper 9 downward.

In FIG. 23(*c*), as the pushing member 26A further descends, the food material 1 and the wrapping paper 9 are laminated together and pushed into the V-shape along the guide 90, and an apex ridge line portion thereof is received on an upper surface of the receiving table 91. At this point, after reached a position shown by a solid line, the pushing member 26A ascends through the lower and upper heating plates 21, 22, and returns to an original upper position shown by a single dotted chain line. Then, the wrapping paper 9 folded into the V-shape is held and pressed by the holding member 55 and the holding-transferring member 56 at both ends of the apex ridge line portion thereof, i.e., at portions protruded from the food material 1 to thereby adhere to each other and be fixed temporarily. Thereafter, in FIG. 22(*b*), the holding member 55 releases the wrapping paper 9 and the food material 1, but the holding-transferring member 56 keeps holding and moves by one pitch to the right side, so that the food material 1 and the wrapping paper 9 are transferred by one pitch. After released the wrapping paper 9 and the food material 1 at a transferred position, the holding-transferring member 56 returns to the left side. Incidentally, a guide and a receiving member for transferring the food material 1 and the wrapping paper 9 (not shown in the drawings) are respectively disposed adjacent to the right sides of the guide 90 and the receiving table 91, and are respectively extended in a horizontal direction with the same cross sections as those of the guide 90 and the receiving table 91. Together with the above mentioned guide and receiving member, the same members as the holding-transferring member 56 are disposed in parallel with the same pitch along the receiving member for transfer. As all of these structural elements are simultaneously reciprocated, the food material 1 and the wrapping paper 9 are sequentially transferred to the right side. In the transferring step, depending on a menu, several materials, such as ground meat, shredded lettuce and cheese, are supplied into the food material 1 from the upper part to be sandwiched. Since processing steps after this step are not related to the subject matter of the present invention, their explanations are omitted.

The conventional food material transferring apparatus has the following disadvantages. Firstly, although there is an advantage that arrangement of inner units reduces a space as seen from a front, there is a disadvantage that it is difficult to control and maintain the respective inner units from the front. Furthermore, desirably, transferring time should be shorten; reliability of the absorption operation should be further improved; and insulation effect of the heating device should be further improved.

Secondly, there is another problem regarding positioning of the food material as described below. When the food materials are laminated and stored on the trays, diameters of the food materials usually have a variation in a range from 155 mm to 181 mm. Thus, on calculation, central positions of the respective food materials vary in a range of 26 mm. Due to characteristics of the apparatus, a hand for absorbing the food material mechanically operates assuming that the food material is accurately placed in a right position. In other words, a holding center of the hand and a center of the stored food material do not always correspond to each other depending on differences in the diameters of the respective food materials. Thus, a slight deviation is created. In case a food material, the center of which deviates from the holding center of the hand, is transferred, inserted into and set in the next heating device, since the food material after heated is folded by a pushing member having a longitudinal portion perpendicular to an inserting direction, when a deviation quantity is large especially in the insertion direction, a folding position is deviated to thereby cause a bad condition. Therefore, it is required that the deviation quantity between the holding center of the hand and the center of the food material in the inserting direction is detected as early as possible with respect to the food material held by the hand, and based on the detected deviation quantity, positioning of the food material to be set in the heating device is corrected.

Furthermore, in the conventional auxiliary pushing device, slight positioning deviation between the food material 1 and the wrapping paper 9 is caused sometimes, i.e., the food material 1 is deviated to one side of the wrapping paper 9, so that there is a risk that not only appearance of a wrapped food material is impaired, but also the wrapping quality of the food material is damaged when the deviation quantity is remarkable such that the food material 1 is protruded from the wrapping paper 9. As causes for impairing the wrapping quality of the food material, the followings can be considered. Firstly, under a condition of FIG. 23(*a*), the wrapping paper 9 placed at an initial position varies a little. Secondly, under a condition of FIG. 23(*b*), when the food material 1 and the wrapping paper 9 are laminated and pushed out, since their positions are not fixed, either right or left half of the wrapping paper 9 first contacts an inclined wall of the guide 90, so that when the wrapping paper 9 is pushed out, the positioning deviation is liable to occur. Especially, it is considered that the second cause affects strongly.

Accordingly, one object of the present invention is to solve the aforementioned problems in the prior art and to provide a food material transferring apparatus, wherein control and maintenance of inner units of the apparatus are facilitated; transferring time is shorted; reliability of an absorbing operation is improved; and an insulating effect of a heating device is increased.

Another object of the present invention is to provide a deviation quantity detecting device of a holding position of circular shape working materials, wherein a deviation quantity between a center of a holding hand and a center of a food material in a straight proceeding direction is detected accurately, quickly without touching the device.

A further object of the present invention is to provide an auxiliary food material pushing device, wherein a positioning deviation between a food material and a wrapping material is prevented and a wrapping quality of the food material is improved.

Further objects and advantages of the invention will be apparent from the following description of the invention.

SUMMARY OF THE INVENTION

A food material transferring apparatus of a first aspect of the present invention of a type that stored soft circular food materials are taken out one by one, heated and transferred downward, comprises: one or more trays for laminating and storing the food materials thereon, the trays being disposed in parallel in a vertical direction; a heating device for heating the inserted and set food material therein; a pushing member driven to ascend and descend or vertically driven such that the food material inserted and set in the heating device is pushed downward while folding along a diameter of the food material; a hand including absorption pads for vacuum-absorbing the food material; an arm having the hand at one end thereof; a bi-directional straight proceeding mechanism for detachably holding the arm at the other end thereof and for allowing the arm to proceed straight in vertical and horizontal directions; and a receiving plate disposed at a lower position of an area corresponding to a horizontal straight proceeding area of the hand so that a dropped food material is received and stored thereon. In the apparatus, the heating device, the pushing member and the trays are disposed in parallel in order from a bottom portion to a top portion to form a process assembly, and the process assembly and the bi-directional straight proceeding mechanism are disposed on a right side and a left side in the apparatus as viewed from the front side. The horizontal straight proceeding of the arm is a movement in front-and-rear directions or a lateral direction, and when the hand proceeds straight in the vertical and horizontal directions, the food material is taken out from the tray, and inserted into and set in the heating device.

In the above structure, it is preferable to adopt either a first food material transferring system or a second food transferring system. In the first food material transferring system, the hand has horizontal beams for holding the food material thereon, and absorption pads disposed under the beams; the tray has a base plate including slits for vertically passing the beams of the hand therethrough, and surrounding walls provided perpendicularly to the base plate not to prevent vertical movement of the beams of the hand and for laminating and setting the food materials therein; and a holding table for temporarily placing the laminated food materials disposed near the heating device and for passing the beams of the hand in the vertical direction. In the second food material transferring system, a hand includes horizontal beams for holding the food material, tray positioning members provided on upper surfaces of the beams, and absorption pads disposed to lower surfaces of the beams; and a holding table is disposed near the heating device to pass the beams of the hand in the vertical direction, and temporarily hold the tray with laminated food materials thereon.

Also, preferably, the absorption pads comprises one or more pairs of pads disposed to correspond to both ends of a diameter of a food material, and the respective pairs are connected to different vacuum pumps. Further, the heating device is preferably formed of a stationary lower heating plate, an upper heating plate driven to ascend and descend or move vertically, fixed insulation side walls surrounding the lower and upper heating plates except a food material inlet, and a movable insulation door disposed on the upper heating plate and for opening and closing the door of the food material inlet when the upper heating plate moves vertically.

A deviation quantity detecting device of a second aspect of the present invention is a device for detecting a deviation quantity in a straight proceeding direction between a work holding center of a hand and a center of a work held by the hand when the hand holds the work and proceeds straight in a plane thereof. The straight proceeding direction is a direction of a straight line connecting the work holding center of the hand and a fixed point provided on the hand by a predetermined distance away from the work holding center. The deviation quantity detecting device comprises: a non-contact type passing sensor provided on a straight line connecting the fixed point and the work holding center, and for detecting passages of the fixed point, a first work outline point near the fixed point and a second work outline point away from the fixed point when the hand proceeds straight and the respective points pass the sensor to thereby output the detected values; distance measuring means for obtaining a first distance between the fixed point and the first work outline point, and a second distance between the fixed point and the second work outline point based on the respective outputs from the passing sensor; and a computing portion for calculating the deviation quantity relating to the straight proceeding direction between the work holding center of the hand and the center of the work based on the obtained first and second distances.

Or, a deviation quantity detecting device is a device for detecting a deviation quantity relating to a straight proceeding direction between a work holding center of the hand and a center of a work held by the hand when the hand holds the work and proceeds straight at a predetermined speed in a plane thereof. The straight proceeding direction is a direction of a straight line connecting the work holding center of the hand and a fixed point provided on the hand by a predetermined distance away from the work holding center. The deviation quantity detecting device comprises: a non-contact type passing sensor provided on a straight line connecting the fixed point and the work holding center, and for detecting passages of the fixed point, a first work outline point near the fixed point and a second work outline point away from the fixed point when the hand proceeds straight and the respective points pass the sensor to thereby output the detected values; time measuring means for obtaining a first time required from the fixed point to the first work outline point, and a second time required from the fixed point to the second work outline point based on the respective outputs from the passing sensor; and a computing portion for calculating the deviation quantity relating to the straight proceeding direction between the work holding center of the hand and the center of the work based on the obtained first and second times and the predetermined speed of the straight proceeding hand.

An auxiliary pushing device of a third aspect of the present invention is a device, by descending a band shape or elongated pushing member in an upright or vertical direction, for laminating a horizontally placed food material and a paper-like wrapping material horizontally placed under the food material and pushing downward the laminated food material and wrapping material while folding into a V-shape along a guide. The auxiliary pushing device comprises: a horizontal receiving table for receiving the laminated food material and the wrapping material to hold the same together with the pushing member; a movable member provided with the receiving table at an upper edge thereof, and for vertically moving between a predetermined upper limit position and lower limit position; energizing means for energizing the movable member upward; and lock means for holding or releasing the movable member at the lower limit position. Incidentally, the whole movable member, energizing means and locking means are constituted as an air pressure type operation cylinder, wherein the movable member corresponds to a piston axis, the energizing means corresponds to an introduction air pressure for raising a piston, and the locking means corresponds to a valve for turning ON and OFF to introduce the air pressure. Alternatively, it is preferable that the energizing means is formed of a spring and the locking means is formed of an engaging member for engaging with and releasing the movable member when driven. Furthermore, it is preferable that the receiving table includes a vacuum absorption portion to hold the wrapping material on an upper surface thereof.

Or, an auxiliary pushing device includes a pair of rotatably closable type movable plates, which, by a band plate shape pushing member descending in a vertical direction, laminates a horizontally placed food material and a paper-like wrapping material placed on a guide position above the movable plates at a closed horizontal position in an initial stage; pushes the food material and wrapping material while folding into a V-shape as the movable plates open; and finally pushes the food material and wrapping paper against a fixed horizontal receiving table. The movable plates as the guide respectively have axes included in the horizontal surface defined at the closed position of the initial stage and disposed parallel to respective sides of the pushing member with an equal distance therebetween; are rotated around the respective axes; and are energized to return to the initial closed position.

Therefore, in the food material transferring apparatus of the first aspect of the invention, the food materials laminated and stored on the tray are taken out one by one by the vacuum absorption hand, and inserted into and set in the heating device to be heated. The food material in a condition inserted into and set in the heating device is pushed downward while being folded along a diameter thereof by the pushing member vertically driven after heating. The hand is detachably held by the bi-directional straight proceeding mechanism through the arm, whereby the hand proceeds straight in vertical and horizontal directions, thus taking out the food material from the tray and inserting into and setting in the heating device. Since the bi-directional straight proceeding mechanism and the process assembly including the heating device, pushing member and tray are respectively disposed in the left side and the right side as viewed from the front side, both the mechanism and assembly are easily accessible. The arm with the hand thereon can be detached from the bi-directional straight proceeding mechanism. Also, when accidentally dropped from the hand in a transferring process, the food material is received on the receiving plate to collect.

Also, as a method for transferring the food material from the tray to the heating device, there are: the first food material transferring system, wherein after only the food materials laminated and stored on the tray are transferred, in a batch, to the holding table near the heating device by carrying the food materials on the upper surfaces of the beams of the hand, each food material is inserted into and set in the heating device by the absorption pads of the hand; and the second food material transferring system, wherein after the food materials placed on the upper surfaces of the beams of the hand are transferred together with the tray, in a batch, to the holding table near the heating device, each food material is inserted into and set in the heating device by the absorption pads of the hand, and upon completion the tray is returned to an initial position.

Also, the absorption pads are formed of a plurality of units, wherein one unit includes a pair of pads, and the respective units are connected to different pumps. Furthermore, the heating device is covered by the insulating surrounding walls except the food material inlet, and the inlet formed of an insulating movable door and integrally formed with the upper plate travels vertically, opens and closes.

In the deviation quantity detecting device of the second aspect of the invention, as the hand proceeds straight, when the fixed point, the first work peripheral point near the fixed point, and the second work peripheral point away from the fixed point pass the passing sensor, the passing sensor untouchably detects passages of the respective points to thereby output the detected values. Based on the outputs, the first distance from the fixed point to the first work peripheral point and the second distance from the fixed point to the second work peripheral point are respectively obtained through the distance measuring means. From the first and second distances, a deviation quantity in the straight proceeding direction between the work holding center of the hand and the center of the work in the straight proceeding direction is obtained through the computing portion.

Or, as the hand proceeds straight, when the fixed point, the first work peripheral point near the fixed point, and the second work peripheral point away from the fixed point pass the passing sensor, the passing sensor untouchably detects passages of the respective points to thereby output the detected values. Based on the outputted values, the first time required for proceeding straight from the fixed point to the first work peripheral point and the second time required for proceeding straight from the fixed point to the second work peripheral point are obtained through the time measuring means. From the first and second times and a predetermined speed of the straight proceeding hand, a deviation quantity in the straight proceeding direction between the work holding center of the hand and the center of the work is obtained through the computing portion.

In the auxiliary pushing device of the third aspect of the present invention, after the descending pushing member laminates the food martial and the wrapping material to sandwich between the receiving table located at the upper limit position and the pushing member itself, the receiving table is drivingly moved to the lower limit position against the upward energizing force by the energizing means while pushing the food material and the wrapping material along the guide. At the lower limit position, the receiving table is stopped when the movable member is held by the locking means to thereby complete folding of the food material and the wrapping material. Then, the pushing member ascends to return to the initial position. The food material and wrapping material kept folding by the receiving table and the guide proceed to the next process, for example, a horizontal transfer process. Thereafter, when the locking means releases the movable member, the receiving table is raised by the energizing force to return to the upper limit position. Incidentally, the receiving table is provided with the vacuum absorbing portion on the upper surface thereof to thereby hold the wrapping material.

Or, when the food material and the wrapping material are pushed downward by the descending pushing member, a pair of movable plates as the guide is opened downward in a V-shape while rotating around the respective axes against the energizing force, so that a friction resistance works against positioning deviation based on the energizing force between the food material and the wrapping material.

BRIEF DESCRIPTION OF THE DRAWINGS

FIG. 4(*b*) is a perspective view of a tray of the first food material transferring system;

FIG. 6(*b*) is a perspective view of a tray of the second food material transferring system;

FIG. 14(*b*) is a signal waveform of the deviation quantity detecting device of FIG. 14(*a*);

FIG. 15(*b*) is a signal waveform of the deviation quantity detecting device of FIG. 15(*a*);

FIG. 16(*b*) is a side view of the auxiliary pushing device of FIG. 16(*a*);

FIGS. 17(*a*)–17(*c*) show operation steps of the first embodiment of the auxiliary pushing device, wherein FIG. 17(*a*) is a front view before a pushing operation, FIG. 17(*b*) is a front view in the middle of the pushing operation, and FIG. 17(*c*) is a front view after the pushing operation;

FIG. 18(*b*) is a side view of the auxiliary pushing device of FIG. 18(*a*);

FIGS. 19(*a*)–19(*c*) show operation steps of the second embodiment of the auxiliary pushing device, wherein FIG. 19(*a*) is a front view before a pushing operation, FIG. 19(*b*) is a front view in the middle of the pushing operation, and FIG. 19(*c*) is a front view after the pushing operation;

FIG. 20(*a*) is a front view of a third embodiment of an auxiliary pushing device;

FIG. 20(*b*) is a side view of the auxiliary pushing device of FIG. 20(*a*);

FIGS. 21(*a*)–21(*c*) show operation steps of the third embodiment of the auxiliary pushing device, wherein FIG. 21(*a*) is a front view of the device before a pushing operation, FIG. 21(*b*) is a front view in the middle of the pushing operation, and FIG. 21(*c*) is a front view after the pushing operation;

FIG. 22(*a*) is a front view of a conventional auxiliary pushing device;

FIG. 22(*b*) is a side view thereof; and

DETAILED DESCRIPTION OF PREFERRED EMBODIMENTS

Figure 2:
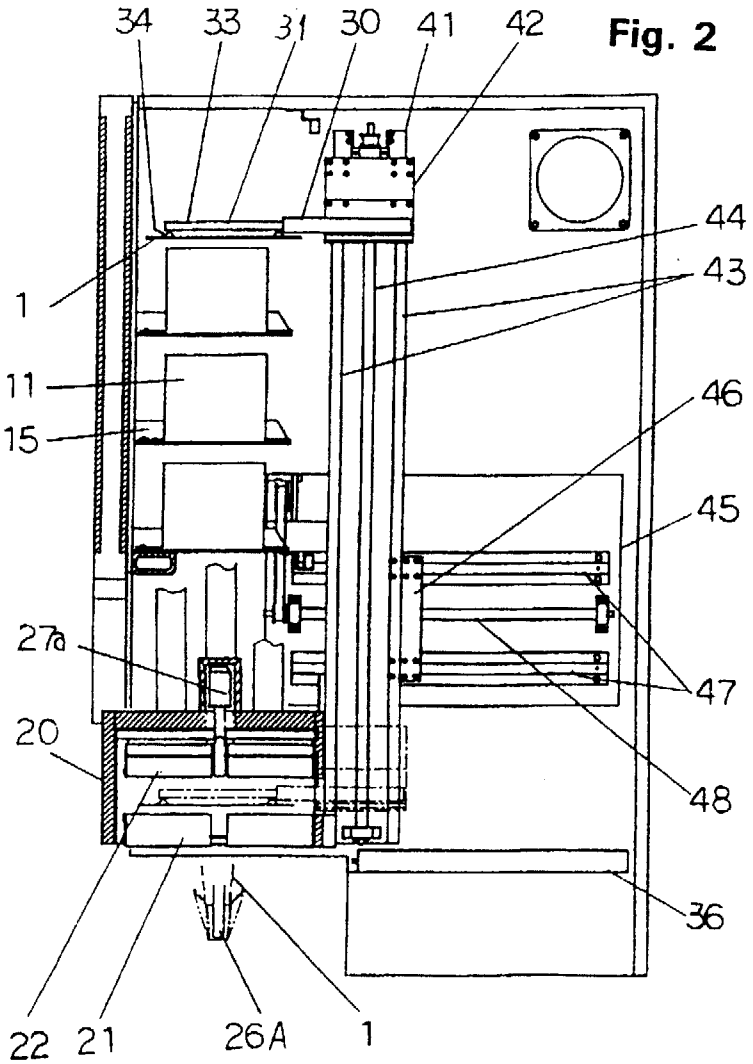
FIG. 2 is a side view of the embodiment.
Figure 1:
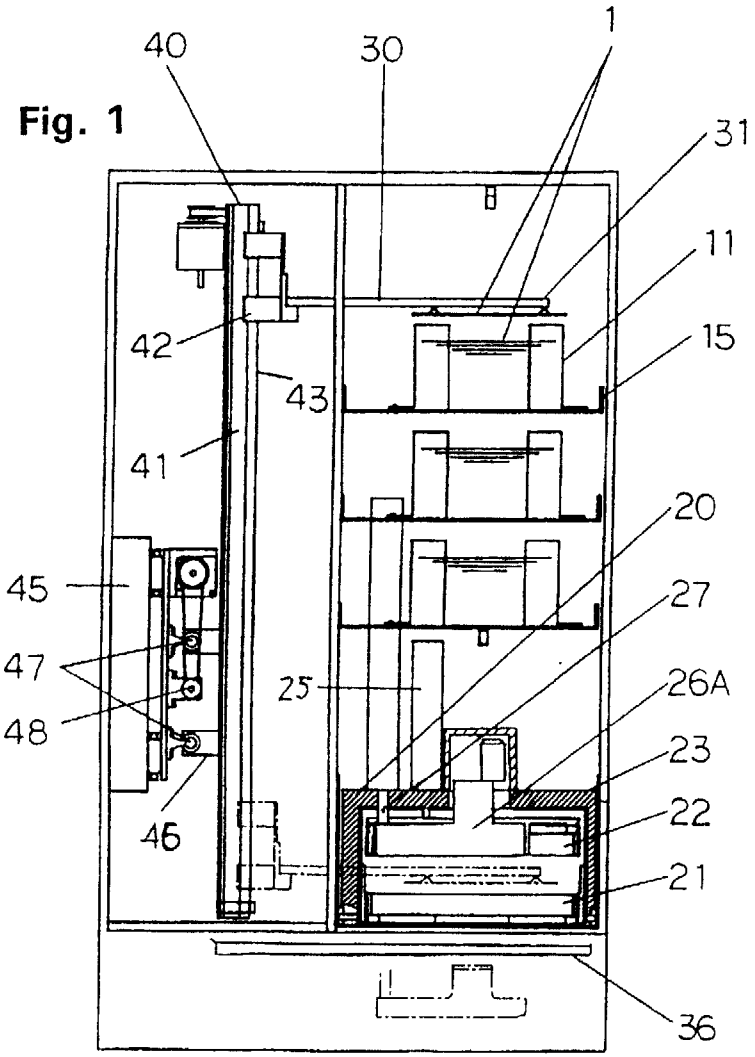
FIG. 1 is a front view for showing an embodiment of a food material transferring apparatus according to the present invention.

An embodiment of a food material transferring apparatus according to the present invention is explained hereinafter with reference to the accompanied drawings. FIG. 1 is a front view of the embodiment, and FIG. 2 is a side view thereof. In the embodiment, soft circular food materials, such as tacos, laminated to be stored on trays are taken out one by one, inserted into and set in a heating device to be heated, and then the heated food material is pushed downward by a pushing device to be folded into a V-shape, and sent to the next processing step.

Figure 4A:
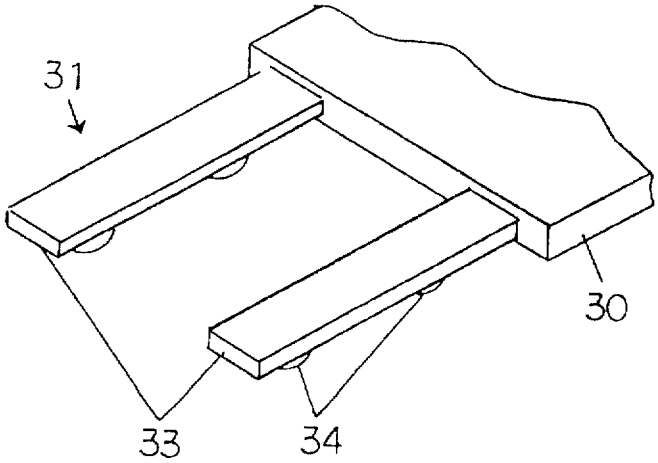
FIG. 4(*a*) is a perspective view of a hand of the first food material transferring system.
Figure 6A:
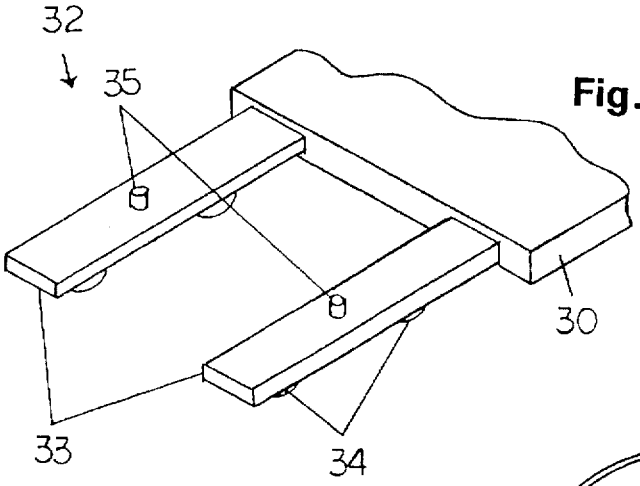
FIG. 6(*a*) is a perspective view of a hand of the second food material transferring system.
Figure 6B:
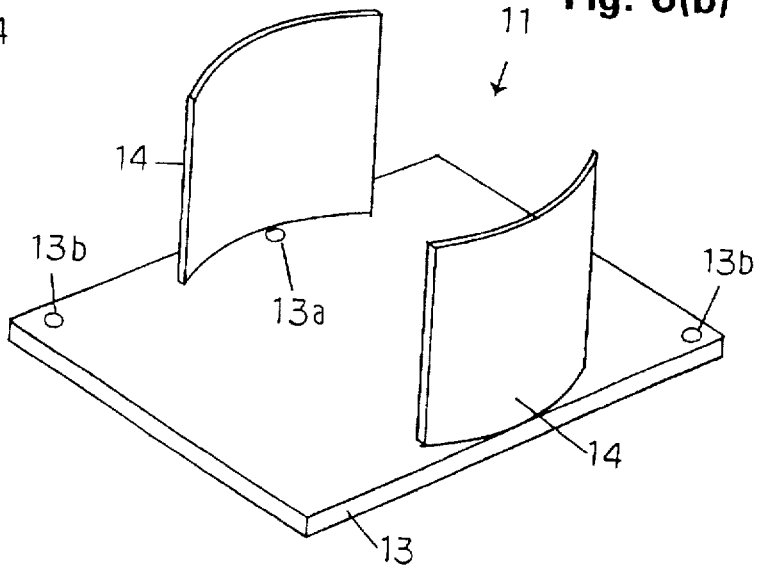
Figure 7:
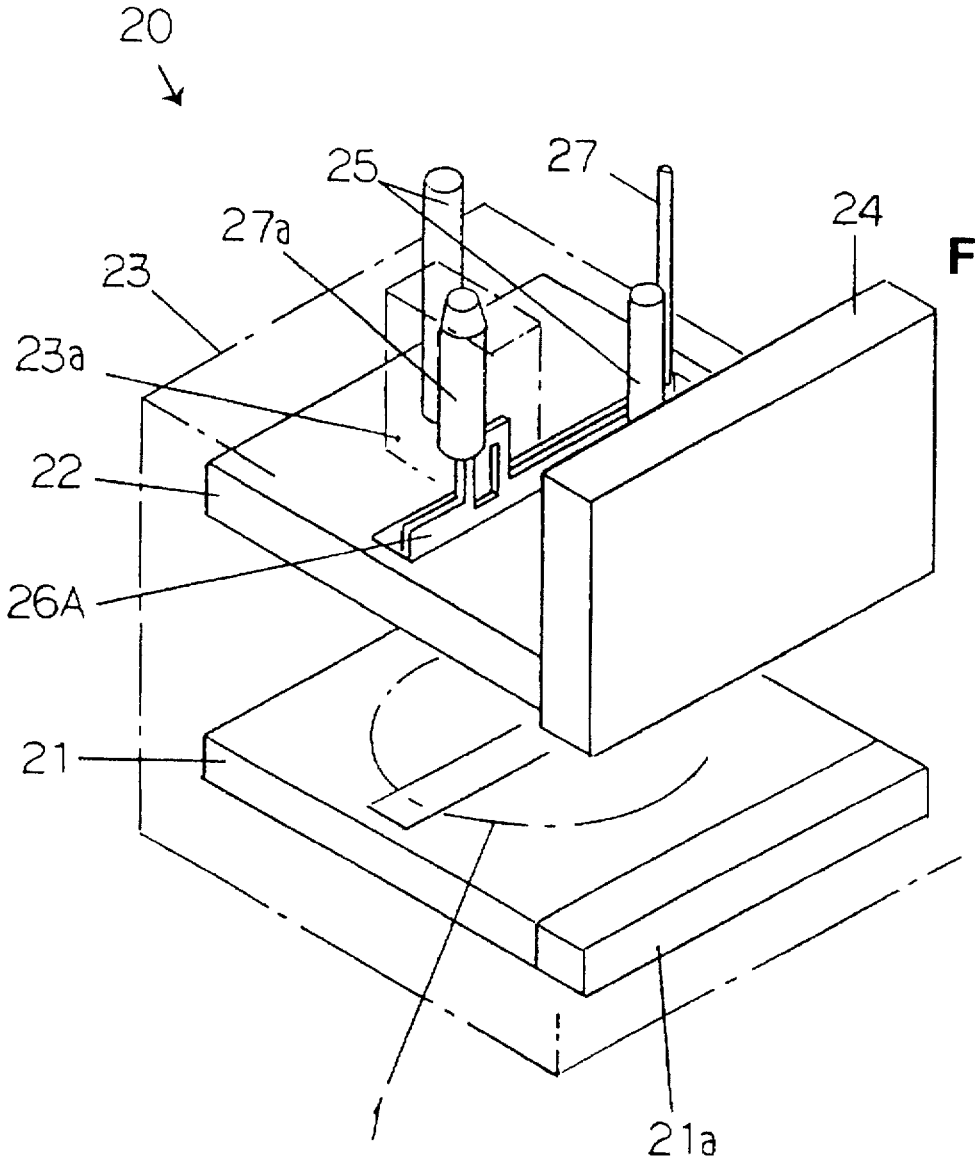
FIG. 7 is a perspective view for showing a heating device and a pushing device in the embodiment.
Figure 8:
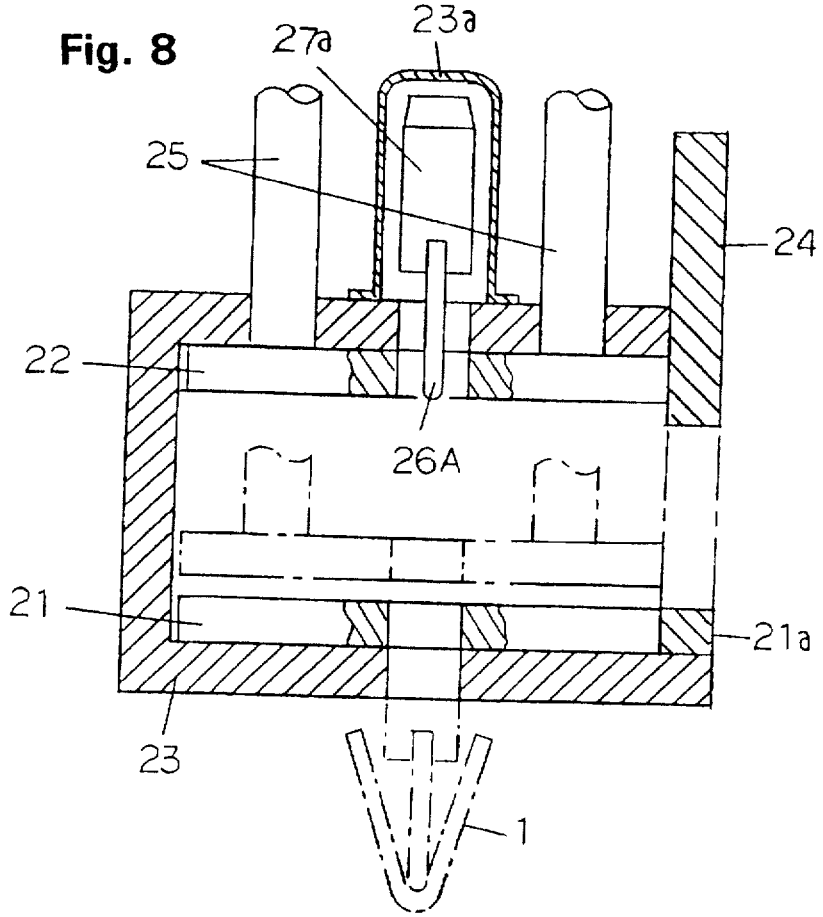
FIG. 8 is a side sectional view of the heating device and the pushing device in the embodiment.
Figure 9:
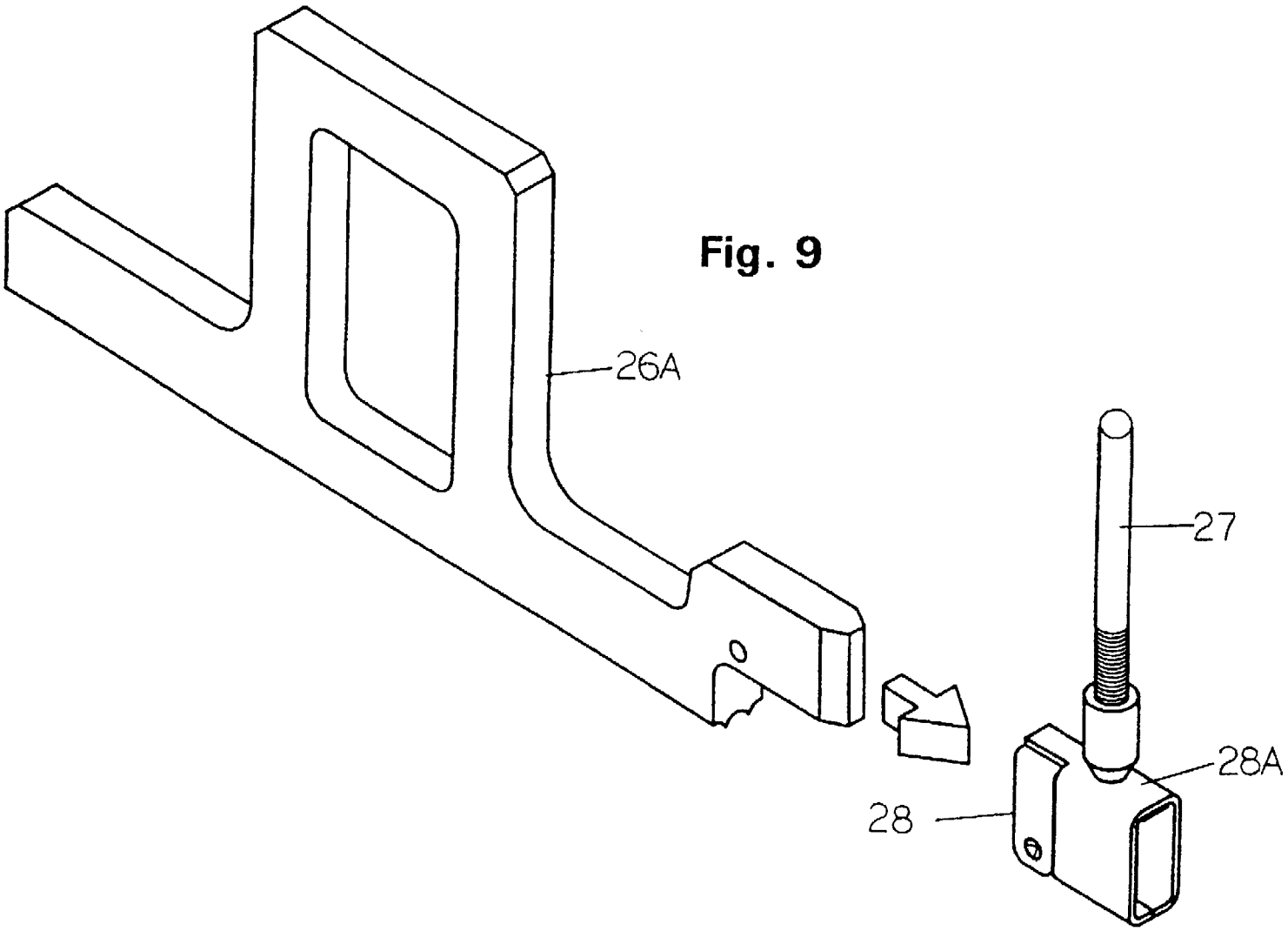
FIG. 9 is a perspective view for showing a first mechanism for detachably providing a pushing member in the embodiment.
Figure 10:
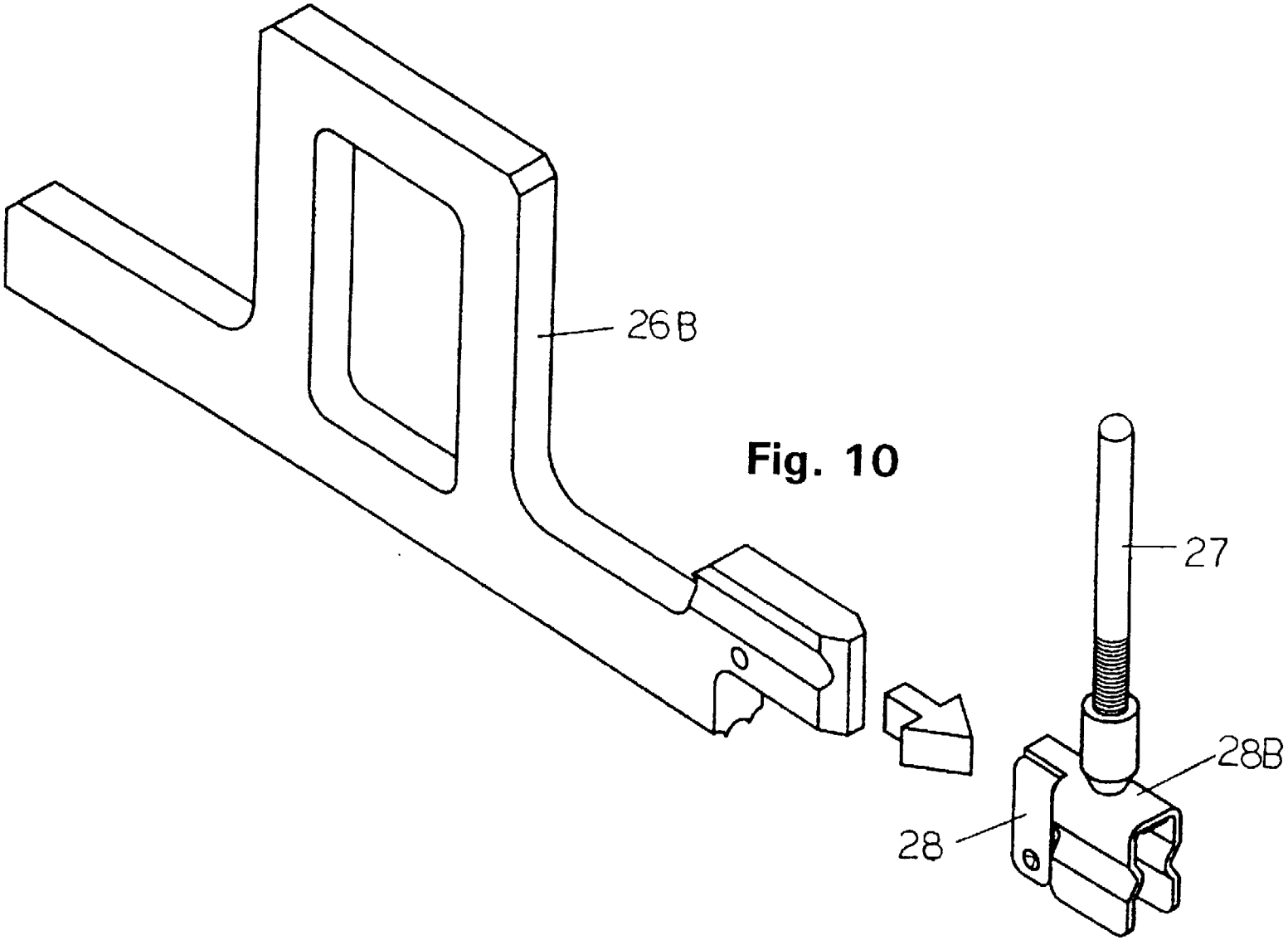
FIG. 10 is a perspective view for showing a second mechanism for detachably providing a pushing member in the embodiment.

In FIGS. 1 and 2, food materials 1 are laminated on trays 11 to be stored thereon. The tray 11 is, as shown in FIG. 6(*b*), formed of a square base plate 13 and two facing arc-shape side walls 14 provided on the base plate 13. Back to FIGS. 1 and 2, the trays 11 are disposed in parallel in three steps on respective three shelf frames 15 provided in up and down directions or a vertical direction, and the trays 11 are fixed by the screws. Under the trays 11, a heating device 20 is disposed. Incidentally, instead of the tray 11, a modified tray 10 as shown in FIG. 4 is used when a different transferring system of the food material 1 is employed, and is described later. The heating device 20, as shown in detail in FIGS. 7 and 8, is formed of a lower heating plate 21, an upper heating plate 22, an insulation case 23 for housing the entire heating device, as shown by a single dotted chain line, and an insulation door 24 for opening and closing an inlet. The insulation door 24 is integrally formed with the upper heating plate 22, and through a first elevating device (not shown) represented by elevating axes 25, the insulation door 24 ascends and descends together with the upper heating plate 22. A pushing member 26A (refer to FIG. 9) for pushing out the heated food material 1 downward is formed of a band plate shape pushing member uprightly disposed with a longitudinal portion in a horizontal direction, and vertically moved by a second elevating device (not shown) represented by a pushing axis 27. Incidentally, the pushing member 26A is substituted by a pushing member 26B as shown in FIG. 10 which is different in an attaching and detaching mechanism to the pushing axis 27, as described later.

In FIG. 1, a vacuum-absorption type hand 31 for taking out the food materials 1 laminated to be stored one by one and releasing them in a predetermined place is, as shown in detail in FIG. 4(*a*), formed of absorption pads 34 and beams 33 for holding the pads 34. The hand 31 is detachably provided to a bi-directional straight proceeding mechanism 40 through an arm 30, and behind a process assembly including the heating device 20, the pushing member 26A, and the trays 11 provided in parallel from the bottom to the top, while moving straight in two directions, i.e. a front-and-rear direction or lateral direction and a vertical direction, the hand 31 transfers the food material 1 (refer to FIG. 2). Incidentally, instead of the hand 31, a hand 32 (as shown in FIG. 6(*a*)) is used when a different transferring system of the food material 1 is used, as described later. When the food material 1 is dropped out in the course of transfer in some reasons, a receiving tray 36 provided at the lowest position receives it.

Also, in FIG. 1, the bi-directional straight proceeding mechanism 40 is formed of an up-and-down part or vertical part 41 for vertically moving an up-and-down table or vertical table 42, and a front-and-rear part or lateral part 45 for horizontally moving a front-and-rear table or lateral table 46 in a front-and-rear or lateral direction. The vertical part 41 is formed of a pair of guiding axes 43 for vertically guiding the vertical table 42 straightforwardly, a boll screw 44 for vertically driving the vertical table 42, and an unnumbered frame. The lateral part 45 is formed of a pair of guiding axes 47 for horizontally guiding the lateral table 46 straightforwardly, a ball screw 48 for horizontally driving the lateral table 46, and an unnumbered frame. The vertical table 42 is detachably provided with the arm 30, and the lateral table 46 is provided with the vertical part 41 integrally (refer to FIG. 2). Explanations of bearings for supporting ball screws 44, 48 and a driving motor are omitted herein.

With the construction as described above, the food materials 1 laminated to be stored on the three-step trays 11 shown in FIG. 1 are taken out one by one by the vacuum-absorption type hand 31, and inserted into the heating device 20 to be set, and heated therein. After heated, the food material 1 is pushed downward by the elevatable pushing member 26A representing the pushing device, and pushed outside. A process assembly including the heating device 20, the pushing device (not shown), and the trays 11 disposed in parallel from the bottom to the top, is disposed on the right side, and the bi-directional straight proceeding mechanism 40 is positioned on the left side as viewed from the front, so that each of the assembly and mechanism is easily accessible by a person, and the arm 30 provided with the hand 31 can be detached from the bi-directional straight proceeding mechanism 40. Therefore, operation and maintenance thereof are facilitated. Also, even when the food material 1 is dropped out from the hand 31 in the course of transfer, the receiving tray 36 receives the dropped food material 1.

Also, as a system for transferring the food material 1 from the tray to the heating device 20, in addition to the aforementioned system to transfer the food material 1 individually, there is another system to transfer the food materials 1 to a position near the heating device 20 in a batch and then to transfer the food material 1 individually. Further, depending on a way of batch-transfer, the batch-and-individual combination transfer system is divided into a first food material transfer system to transfer only the laminated food materials 1 and a second food material transfer system to transfer the food material 1 together with the tray storing the food material thereon.

Figure 3:
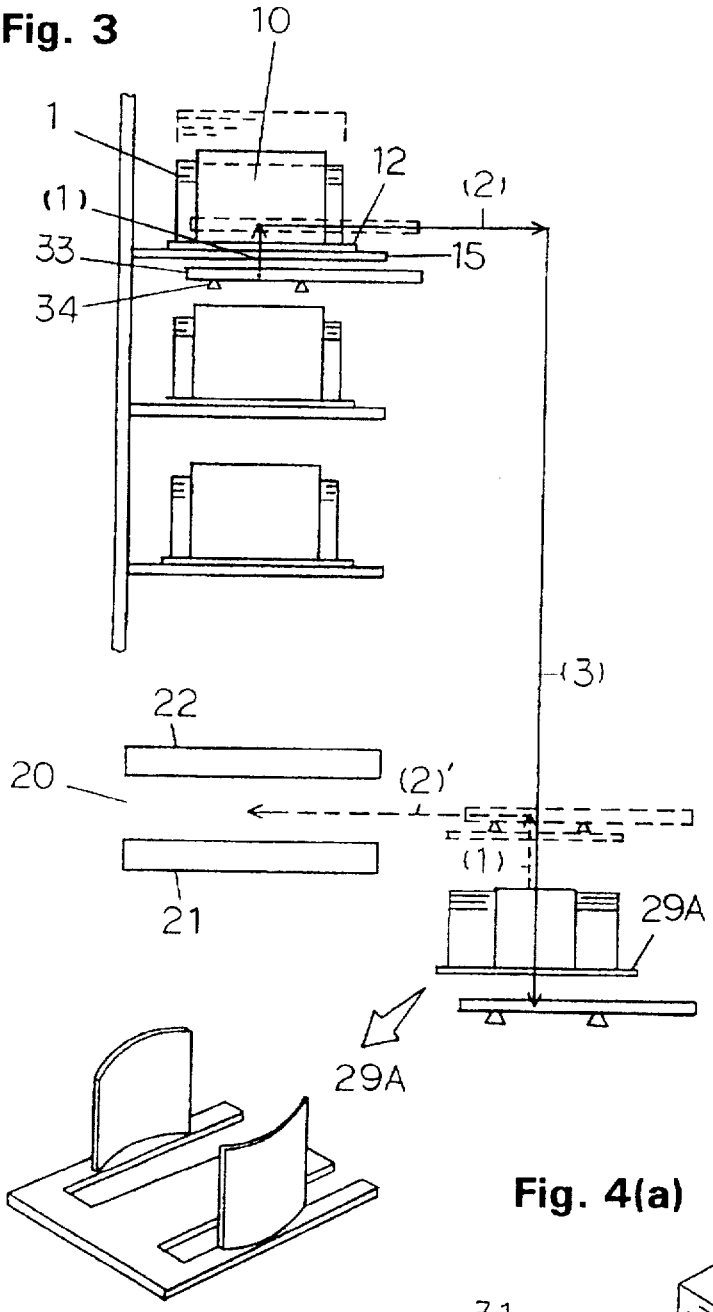
FIG. 3 is a route diagram of a first food material transferring system in the embodiment.

FIG. 3 is a view showing a process of the first food material transfer system, FIG. 4(*a*) is a perspective view of the hand 31, and FIG. 4(*b*) is a perspective view of the tray 10. In FIG. 4(*a*), the hand 31 provided to a forward end of the arm 30 is formed of a pair of band plate shape beams 33 disposed in parallel on a horizontal phase, and four absorption pads 34, in total, disposed on lower surfaces of the beams 33. In FIG. 4(*b*), the tray 10 is formed of a base plate 12 provided with slits for allowing the beams 33 to pass therethrough, and a pair of facing arc shape side walls 14. The tray 10 is fixed to a shelf frame (not shown in FIG. 4(*b*) but refer to the shelf frame 15 in FIG. 1) by screws.

In the first food material transfer system, the batch-transfer by the beams 33 includes, as shown in FIG. 3, an ascending operation (1) for scooping up all the food materials 1 laminated to be stored on the tray 10 from a lower side of the base plate 12 of the tray 10 and to place the food materials on upper surfaces of the beams 33; a horizontal operation (2) for pulling to the right side; and a descending operation (3) for transferring all the food materials 1 in a batch toward the holding table 29A positioned near the heating device 20 and provided with collapse preventive frames and slits for allowing the beams 33 to pass therethrough. Then, the latter half individual transfer step includes the ascending operation (1) and the horizontal operation (2)' to the left side wherein the absorption pads 34 of the beams 33 absorb the food materials 1 on the holding table 29A one by one to insert into the heating device 20 for setting. The first food material transfer system comprises the first half single batch-transfer in a long distance and a plurality of individual transfers in the latter half at the same number of times as that of the food materials 1, so that, as described before referring to FIG. 1, compared with repetition of individual transfers of the food materials 1 from the tray 11 to the heating device 20 to be inserted, the first food material transfer system reduces operation time. Incidentally, the hand 31 and the tray 11 used in the individual transfer described above are respectively the same as the hand 31 used in the first food material transfer system and the tray 11 used in the second food material transfer system described later.

Figure 5:
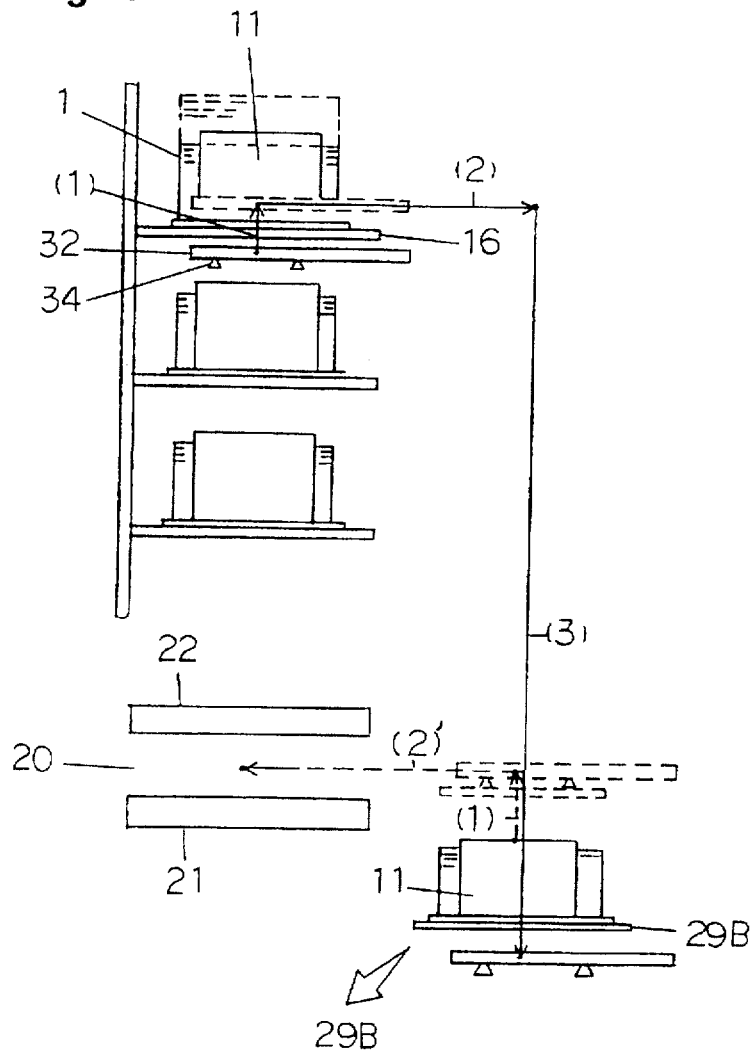
FIG. 5 is a diagram for showing a route path of a second food material transferring system in the embodiment.

FIG. 5 is a view for showing a process of the second food material transfer system, FIG. 6(*a*) is a perspective view of a hand 32, and FIG. 6(*b*) is a perspective view of a tray 11. In FIG. 6(*a*), in addition to a pair of band plate shape 34, in total,r absorption pads 34, in total, disposed to the lower surfaces of the beams 33, the hand 32 further includes positioning pins 35 provided on the upper surfaces of the beams 33 to project upward. In FIG. 6(*b*), the tray 11 is formed of the base plate 13 and a pair of facing arc shape side walls 14. Instead of the slits in the first food material transfer system, the base plate 13 has positioning holes 13*a* corresponding to the pins 35 and holes 13*b* into which positioning pins provided on a shelf frame 16 with positioning pins (as shown in FIG. 5) are fitted.

In the second food material transfer system, a batch-transfer by the beams 33 includes, as shown in FIG. 5, the ascending operation (1) for lifting the tray 11 with the food materials 1 laminated thereon from a lower side of the base plate 13; the horizontal operation (2) for pulling toward the right side; and the descending operation (3) for descending to the holding table 29B located near the heating device 20 and provided with the positioning pins and slits for allowing the beams 33 to pass therethrough. The latter half individual transfer comprises, in the same manner as in the first food material transfer system, the ascending operation (1) and the horizontal operation (2)' wherein the food materials 1 on the holding table 29B are absorbed one by one by the absorption pads 34 of the beams 33, then inserted into the heating device 20 to be set and moved to the left side. In this case, however, an operation for returning the emptied tray 11 to the original shelf frame 16 is required. Although the returning operation is needed, the second food material transfer system has various advantages such that compared with the transfer operation described first in the embodiment, time is shortened; and compared with the first food material transfer system, in the course of the batch-transfer of the food materials 1, there is no risk of the laminated food materials 1 being collapsed, so that the temporary holding table 29B does not require the collapse-preventive frame to thereby simplify the structure.

Next, the heating device 20 and the pushing device are explained referring to a perspective view in FIG. 7 and a side view in FIG. 8. In FIG. 7, the heating device 20 comprises a pair of heater-installation-type lower heating plate 21 and vertically movable upper heating plate 22; an insulation case 23 shown by a single-dotted chain line for insulatingly covering the pair of heating plates to effectively use heat; an insulation door 24; and an insulation member 21*a*. The insulation case 23, except for an inlet for the food material 1 on the side of the insulation door 24, is rectangular entirely surrounding the lower heating plate 21 and the upper heating plate 22. The insulation door 24 is affixed at a left side surface of a lower edge thereof to a right edge surface of the upper heating plate 22 to open and close the inlet as an opening part on the right side (the rear surface side in FIG. 1) of the insulation case 23. Also, the insulation member 21*a* is fixed to a right edge surface of the lower heating plate 21. The lower heating plate 21 and the upper heating plate 22 are respectively provided with rectangular holes for allowing the pushing member 26A to pass therethrough. A bottom wall of the insulation case 23 is provided with a rectangular hole for allowing the pushing member 26A to pass therethrough. Also, an upper wall of the insulation case 23 is provided with a rectangular hole for allowing the pushing member 26A and the guiding axis 27*a*fixed to the pushing member 26A to pass therethrough and two kinds of round holes for allowing the pushing axis 27 fixed to the pushing member 26A and elevating axes 25 fixed to the upper heating plate 22 to pass therethrough (none of the aforementioned holes of the insulation case 23 are shown). The elevating axes 25 and the pushing axis 27 are output axes of air pressure operating cylinders as elevating devices corresponding to the elevating axes 25 and the pushing axis 27. The pushing member 26A is a belt shape plate member (refer to FIG. 9) having an upward projecting square part, and capable of pushing out while bending the food material 1 into a V-shape along the diameter thereof. The projected square part of the pushing member 26A facilitates bending of the food material 1 into the V-shape. Also, the guiding axis 27*a*is fixed to the projected square part, and when the pushing member 26A moves vertically, the guiding axis 27*a*is fitted into the rectangular holes in the lower heating plate 21 and the upper heating plate 22 to thereby prevent the lateral deviation of the pushing member 26A. The insulation case 23 is provided on the upper surface thereof with an upwardly projecting insulation cover 23*a* for protecting the pushing member 26A and the guiding axis 27*a*. A side view in FIG. 8 supplementally shows the aforementioned structure. Namely, the heating device 20 is surrounded therearound by the insulation walls except the inlet for the food materials as one end surface of the rectangular insulation case 23, and the inlet is vertically moved and is opened or closed by the insulation door 24 integrally movable in association with the upper heating plate 22 only when the food material is inserted, so that insulation effect can be improved.

Here, the pushing member 26A and the pushing axis 27 are designed to be easily detachable for facilitating operation and maintenance. FIG. 9 is a perspective view illustrating a first detachable mechanism corresponding to the pushing member 26A. In the drawing, to the lower end part of the pushing axis 27 are integrally fixed a connector 28A of a hollow rectangular shape and a reversed U-shape positioning member 28 having hemispherical convex parts projecting inward at respective leg portions thereof. The pushing member 26A has at a right end part thereof an inserting part with holes and a rectangular cross section, and is moved as shown by an arrow in the drawing to be inserted into and connected to the connector 28A, and at the same time the convex parts of the positioning member 28 are fitted into the holes of the inserting part to thereby position.

Another detachable mechanism is explained hereunder referring to a perspective view in FIG. 10 as a second detachable mechanism. In the drawing, to the lower end part of the pushing axis 27 are fixed a reversed U-shaped spring connector 28B having stripe convex parts projecting inward and extending in a widthwise direction at respective leg parts thereof, and the same positioning member 28 as in the first detachable mechanism. The pushing member 26B has at a right end thereof an inserting part with holes, grooves and a rectangular cross section, is moved as shown by an arrow in the drawing to be inserted into and connected to the connector 28B, and at the same time the convex parts of the positioning member 28 are fitted into the holes of the inserting part to thereby position.

Figure 11:
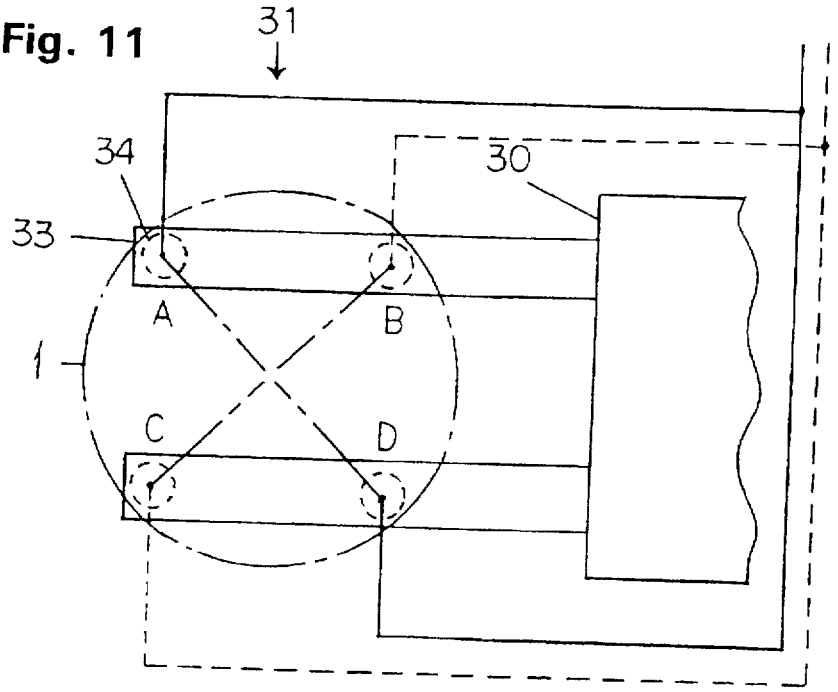
FIG. 11 is a diagram for showing a pipe arrangement for absorption pads of the hand in the embodiment.

A structure for improving reliability of the absorption pads is explained hereinafter referring to FIG. 11. FIG. 11 is a flow chart of the absorption pads 34 of the hand 31. In the drawing, the hand 31 illustrated as a plan view includes a pair of beams 33 disposed in parallel at the forward end of the arm 30, and two absorption pads provided on each beam 33, i.e., four absorption pads 34 in total. The absorption pads 34 on the upper beam 33 in the drawing are designated as A and B, and the absorption pads 34 on the lower beam 34 are designated as C and D. The absorption pads A and B absorb respective portions in the vicinity of the respective ends of two perpendicularly crossing diameters of the food material 1, and the absorption pads C and D absorb respective portions in the vicinity of the other ends of the two perpendicularly crossing diameters of the food material 1. Here, the absorption pads A and D are connected to one vacuum pump (not shown) through a piping shown by solid lines, and the absorption pads B and C are connected to another vacuum pump (not shown) through a piping shown by broken lines. Therefore, assuming that either of the vacuum pumps is out of order, one pair of the absorption pads A and D or another pair of the absorption pads B and C can normally absorb the food material 1, so that absorbing reliability can be increased. Generally, in case plural pairs of the absorption pads corresponding to both ends of one diameter of the food material 1 are provided, as the number of the pairs increases, absorption reliability is increased, while being less economical. From an overall point of view, as shown in the embodiment, the two pair-type of the absorption pads, i.e., the four absorption pads in total, have been adopted.

Figure 12:
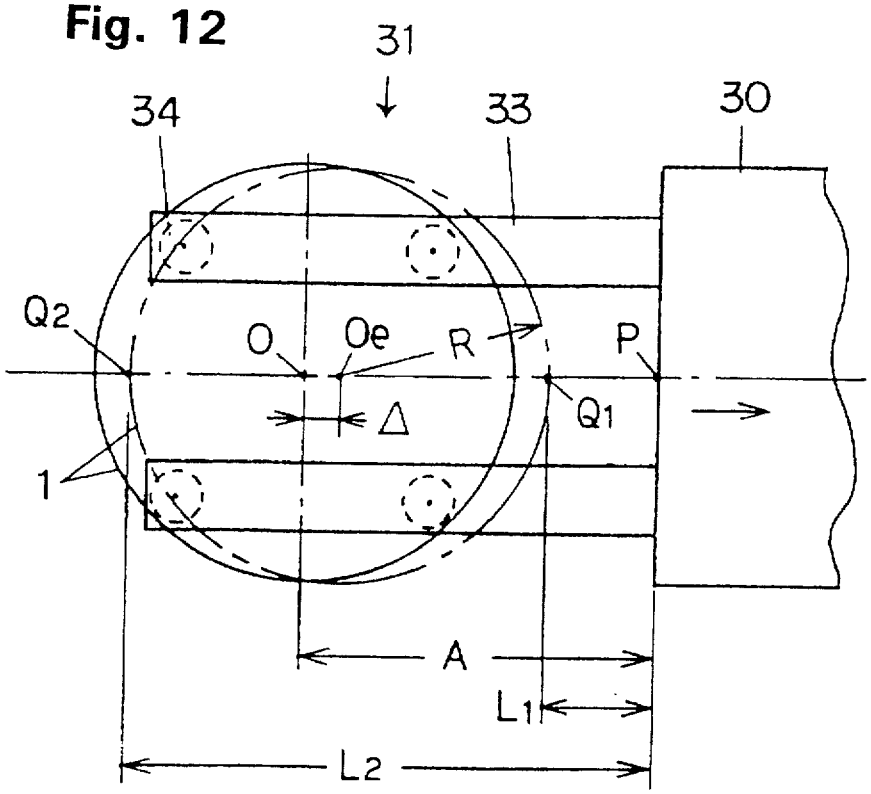
FIG. 12 is an explanatory view for showing a principle under a first deviated condition of an embodiment of a deviation quantity detecting device.

Next, an embodiment of a deviation quantity detecting device in the embodiment of the food material transferring apparatus is explained referring to the drawings. FIG. 12 is a view for explaining a principle in a first deviated condition relating to operation of the deviation quantity detecting device. The first deviated condition is a condition wherein a center of the food material deviates in the straight proceeding direction against a food-holding center of the hand. In the drawing, the aforementioned hand 31 of the food material transferring apparatus includes a pair of parallel beams 33 and two absorption pads disposed on the lower surface of each beam 33, i.e. four absorption pads 34 in total, and disposed at the forward end of the arm 30. After having taken out the food material 1, the hand 31 proceeds straight in the right direction as shown by an arrow, and a deviation quantity is detected in the course of the straight movement. The food-holding center of the hand 31 is designated as a holding center 0 of the four absorption pads 34, and a left edge of the arm 30 deviated by A from the holding center 0 in the straight proceeding direction of the hand 31, is designated as a fixed point P.

Figure 14B:
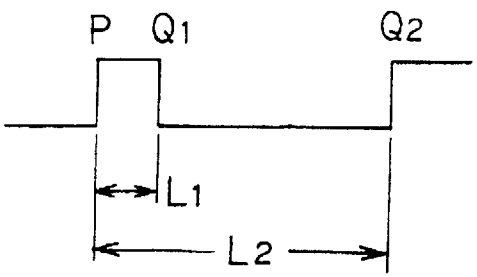
FIG. 14(*a*) is a diagram of a first embodiment of the deviation quantity detecting device.
Figure 14A:
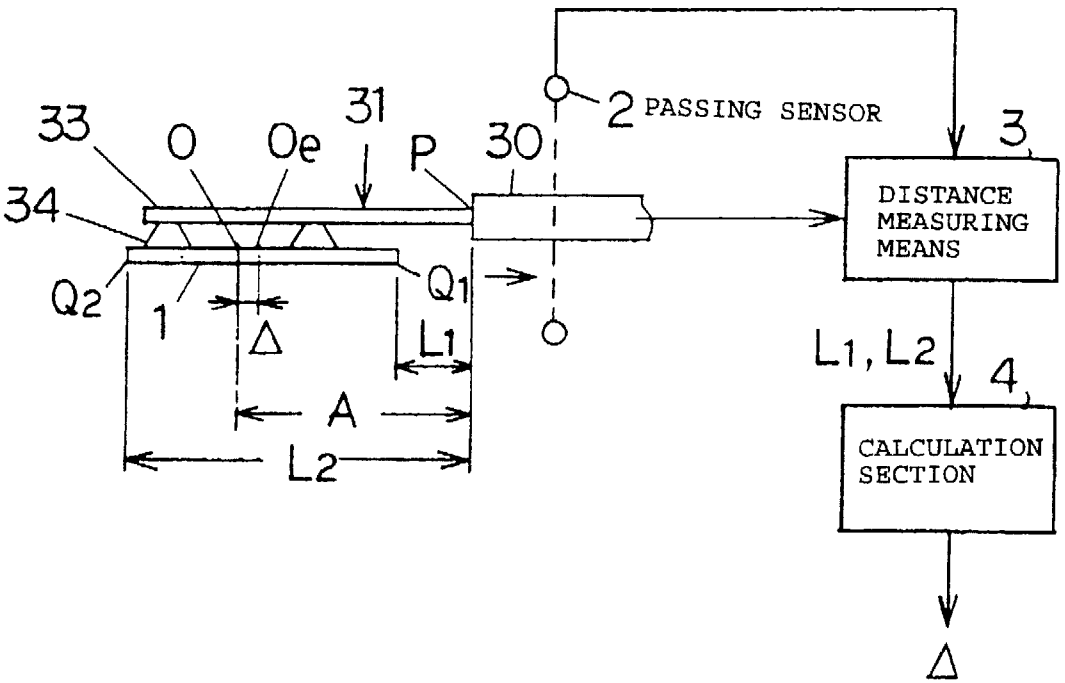

Now, the food material 1 shown by a solid line is in a normal position without any deviation, and the food material 1 shown by a broken line is deviated at the center $O_e$ thereof by Δ from the holding center O of the hand 31 in the straight proceeding direction. Points where a straight proceeding course line passing the holding center O intersects the periphery of the food material 1, are designated as $Q_1$ and $Q_2$. A fixed passing sensor 2, such as a transmission type light sensor formed of a light emitter and a light receiver, as shown in FIG. 14(*a*) is disposed so that a light axis of the passing sensor 2 passes through the straight proceeding course line passing the holding center O of the hand 31 to be perpendicular to the surface of the food material 1, i.e. paper surface in the drawing. The passing sensor 2 detects passages of the points P, $Q_1$ and $Q_2$. Assuming that a line segment $P \cdot Q_1 = L_1$ and a line segment $P \cdot Q_2 = L_2$, $$L_1 = A - R - \Delta \quad (1)$$

$$L_2 = A + R - \Delta \quad (2)$$

Therefore, equation (1)+equation (2) leads to:

$$\text{deviation quantity } \Delta = (2A - L_1 - L_2)/2 \quad (3).$$

Figure 13:
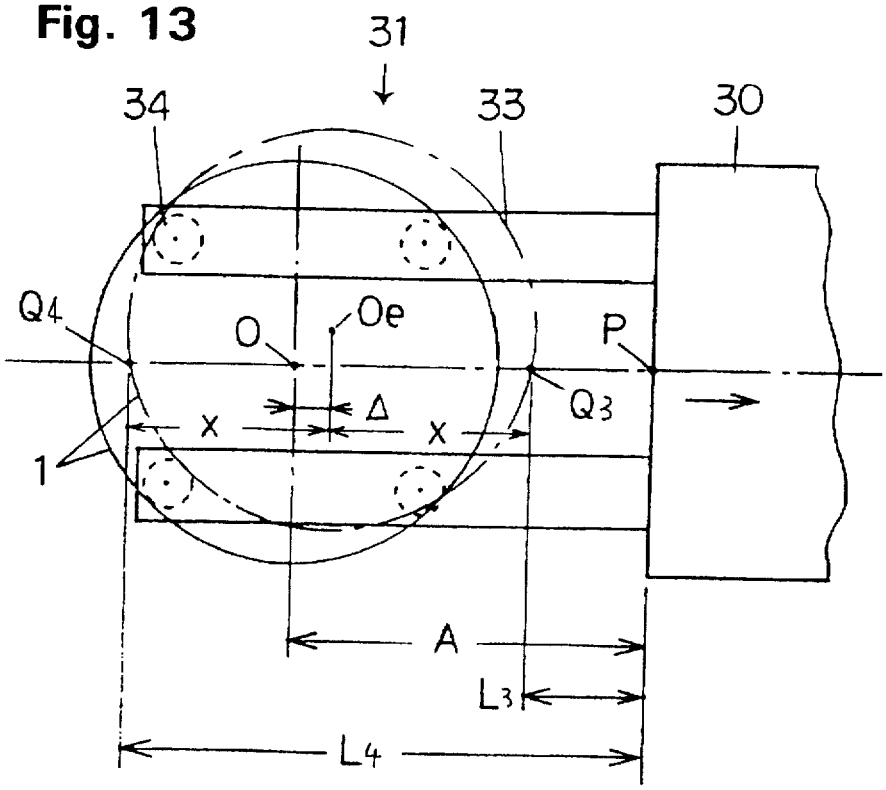
FIG. 13 is an explanatory view for showing a principle under a second deviated condition thereof.

Next, an operation principle of the deviation quantity detecting device in a second deviation condition is explained referring to FIG. 13. The second deviation condition is a condition wherein the center of the food material is deviated from the food material holding center of the hand in the straight proceeding direction, and at the same time in a direction perpendicular to the straight proceeding direction. In the drawing, the center $O_e$ of the food material 1 shown by a single dotted chain line is deviated by Δ from the food material holding center O of the hand 31 in the straight proceeding direction, and also deviated in a direction perpendicular to the straight proceeding direction, i.e., in a vertical direction in the drawing. The food material 1 shown by a solid line is in a normal position thereof with no deviation.

Points where the straight proceeding line passing the holding center O intersects the periphery of the food material 1, are designated as $Q_3$ and $Q_4$, and the fixed passing sensor 2 (refer to FIG. 14(*a*)) detects passages of the respective points P, $Q_3$ and $Q_4$ shown in FIG. 13. Now, assuming that a line segment $P \cdot Q_3 = L_3$ and a line segment $P \cdot Q_4 = L_4$, $$L_3 = A - x - \Delta \quad (4)$$

$$L_4 = A + x - \Delta \quad (5)$$

Therefore, equation (4)+equation (5) leads to:

$$\text{deviation quantity } \Delta=(2A-L_3-L_4)/2 \quad (6).$$

Actually, since the deviation quantity of the center $O_e$ of the food material 1 from the holding center O in the direction perpendicular to the straight proceeding direction under the second deviated condition is little, approximately, $L_3=L_1$, and $L_4=L_2$.

As clear from the above, under the first and second deviated conditions, the deviation quantity Δ between the food material holding center O of the hand 31 and the center $O_e$ of the deviated food material 1 in the straight proceeding direction can be obtained from substantially the same equations (3) and (6).

Incidentally, under the second deviated condition, the deviation quantity Δ of the center $O_e$ of the food material 1 in the direction perpendicular to the straight proceeding direction passing the food material holding center O of the hand 31 can be easily detected by the known art, for example, a passing sensor array disposed in parallel in the direction perpendicular to the straight proceeding direction. As described later, however, a little amount of the deviation quantity in the direction perpendicular to the straight proceeding direction is not inconvenient for transferring the food material. Therefore, practically, the deviation quantity in the direction perpendicular to the straight proceeding direction is not detected.

FIGS. 14(*a*),(*b*) relate to a first embodiment of the deviation quantity detecting device, wherein FIG. 14(*a*) is a schematic view of the device, and FIG. 14(*b*) shows a signal wave. Let's assume that the food material 1 is in the first deviated condition. In FIG. 14(*a*), the arm 30 and the hand 31 are shown as side views, and move straight in an arrow direction. The light axis of the passing sensor 2 intersects perpendicularly to the straight proceeding route line passing the absorbing center O of the hand 31. Distance-measuring means 3 has a system to measure a moving distance, i.e., progress, of the arm 30 in association with movement of the arm 30 or a driving mechanism of the arm 30, and measures a straight proceeding distance of the hand 31 based on outputs from the passing sensor 2. Namely, in FIG. 14(*b*), the distance-measuring means 3 measures a line segment $P \cdot Q_1=L_1$ based on respective outputs (signal changes) when passing points P, $Q_1$, and a line segment $P \cdot Q_2=L_2$ based on respective outputs (signal changes) when passing points P, $Q_2$. Next, referring to FIG. 14(*a*), a calculation section 4 operates the aforementioned equation (3) to obtain a deviation quantity Δ based on the above $L_1$, $L_2$.

Figure 15B:
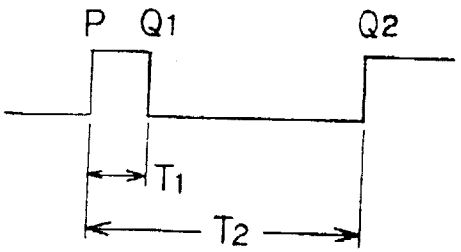
FIG. 15(*a*) is a diagram of a second embodiment of the deviation quantity detecting device.
Figure 15A:
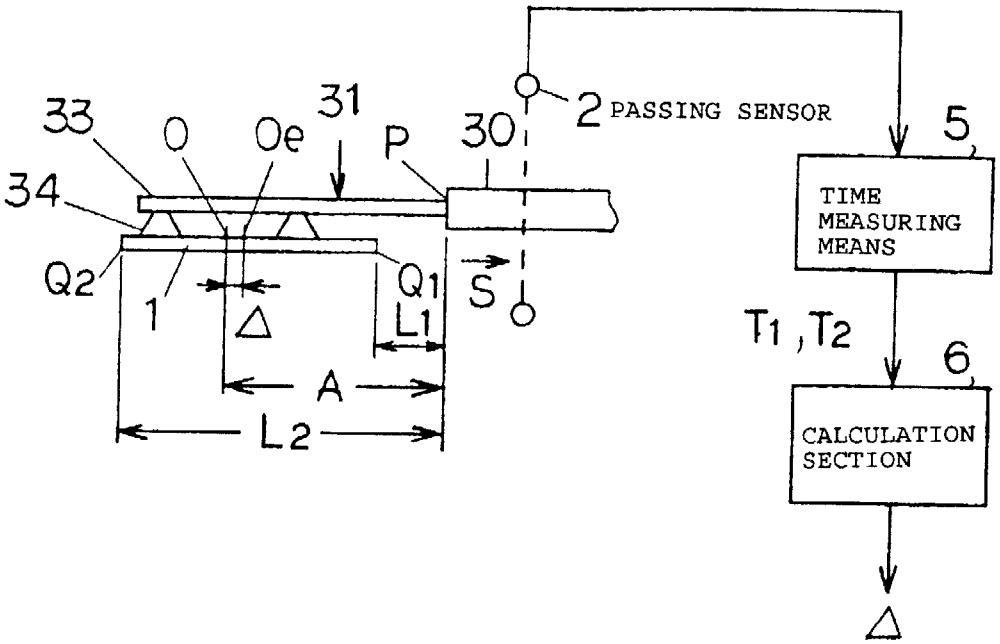

FIGS. 15(*a*),(*b*) relate to a second embodiment of the deviation quantity detecting device, wherein FIG. 15(*a*) is a schematic view of the device, and FIG. 15(*b*) shows a signal wave. The second embodiment of the device is different from the first embodiment in that the arm 30 and the hand 31 proceed straight at a predetermined speed, and instead of the distance, time is measured to calculate a distance=the predetermined speed×time. In FIG. 15(*a*), time-measuring means 5 is shown instead of the distance-measuring means 3 in the first embodiment. The time-measuring means 5 measures, based on two outputs from the passing sensor 2, a time interval between the two outputs. In FIG. 15(*b*), a time interval $T_1$ is measured by respective outputs, i.e., signal changes, when passing points P, $Q_1$, and a time interval $T_2$ by respective outputs, i.e., signal changes, when passing points P, $Q_2$. Then, referring back to FIG. 15(*a*), a calculation section 6 operates the following equation (7) to obtain the deviation quantity Δ based on the respective time intervals $T_1$ and $T_2$.

$$\Delta=(2A-ST_1-ST_2)/2 \quad (7)$$

In the equation, Δ represents a distance between the center of the hand holding and the fixed point, and S represents the predetermined speed. The second embodiment of the deviation quantity detecting device, compared with the first embodiment thereof, can use the time-measuring means 5, such as a clock or a timer, having simpler structure and operation than those of the distance-measuring means 3, so that the detecting device can be simplified in the structure and easily used.

A step for applying the respective embodiments of the deviation quantity detecting device to the food material transferring apparatus is a process wherein the hand 31 absorbs the stored food material 1 and horizontally proceeds straight from the position shown in the drawing to the right side in the side view of the apparatus shown in FIG. 2. The hand 31, after the horizontal straight proceeding, descends along a vertical line passing near a position where the lateral table 46 is disposed in the drawing, and reaches a position shown by a single-dotted chain line, corresponding to the inlet of the heating device 20. From this position, again, the hand 31 horizontally proceeds straight to the left side, and inserts the absorbed food material 1 into an inner portion of the heating device 20 for setting. Therefore, based on the deviation quantity detected at an initial stage of the horizontal straight proceeding to the right side, the moving distance is corrected in an opposite direction by the same amount as the detected deviation quantity at a stage of horizontal straight proceeding to the left side to insert the food material 1 for setting, so that the position for inserting the food material 1 can be normalized. Namely, by the known art, positioning of the lateral table 46 in the horizontal direction is corrected. Incidentally, in view of a position of the pushing member 26A for folding the food material 1 into a V-shape, while the deviation quantity (refer to Δ in FIG. 12) in the horizontal direction of the food material 1 in the heating device 20 is required to be approximately zero, a little amount of deviation quantity in a direction perpendicular to the paper surface does not cause inconvenience. Therefore, the deviation quantity in the direction perpendicular to the paper surface is practically neither detected nor corrected.

Next, first, second, and third embodiments of an auxiliary bushing device in the embodiment of the food material transferring apparatus are explained hereinafter referring to the drawings.

Figures 16A, 16B:
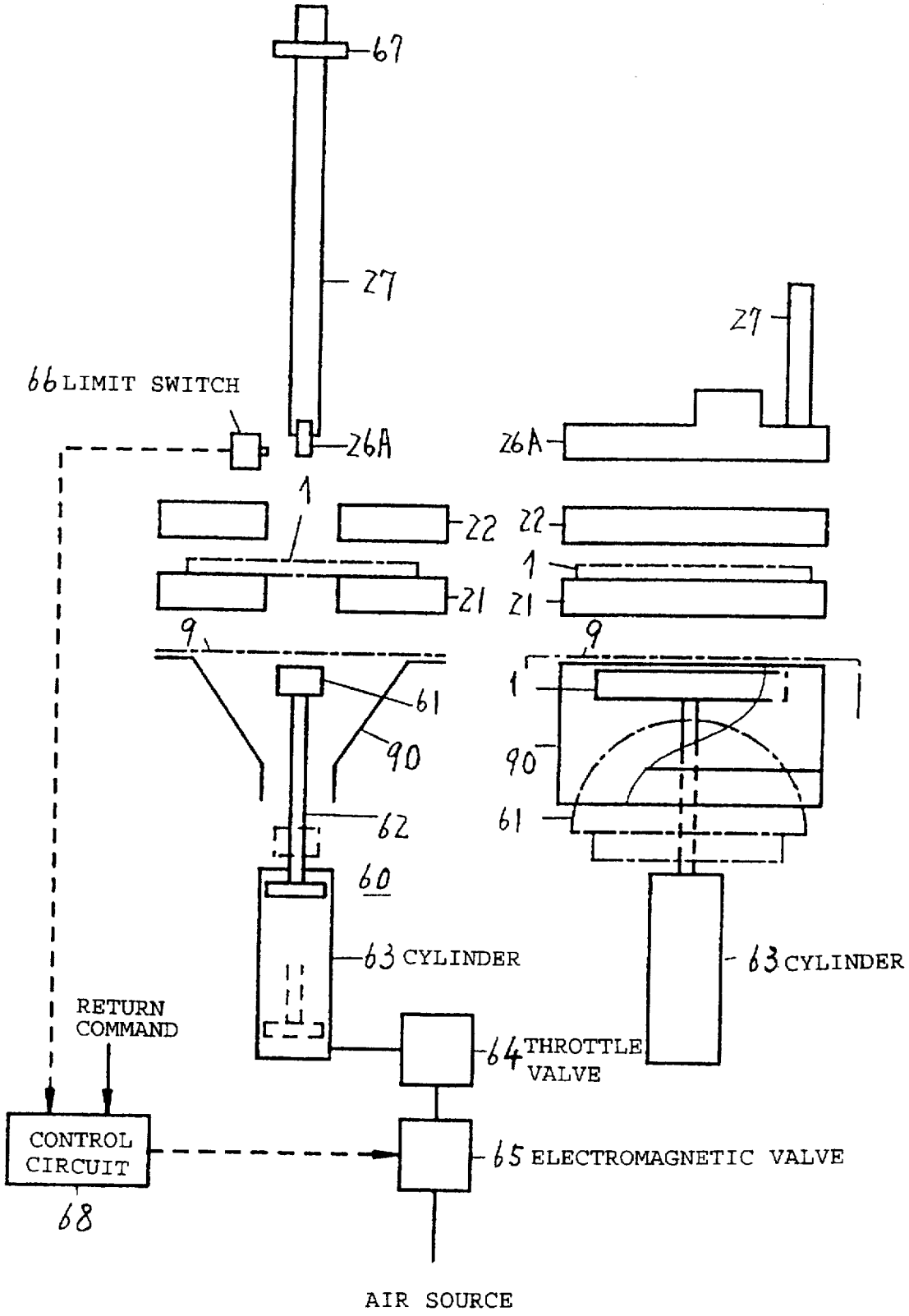
FIG. 16(*a*) is a front view of a first embodiment of an auxiliary pushing device.

FIGS. 16(*a*), (*b*) relate to the first embodiment of the auxiliary pushing device, wherein FIG. 16(*a*) is a plan view thereof, and FIG. 16(*b*) is a side view thereof. The first embodiment of the auxiliary pushing device is different from the prior art in structures of the receiving table and therearound. More specifically, the receiving table is rotatably guided in a vertical direction while being energized upward; at the same time, is located at the uppermost position for receiving a wrapping paper at an initial stage; is driven to descend after a food material and the wrapping paper are sandwiched in a laminated state between the receiving table and a descending pushing member; and is positioned in the predetermined position in the embodiment of the prior art, i.e. the lowermost position, to be held thereat. Then, after the pushing member is elevated to return, the receiving table held at the lowest position is released and elevated by an energizing force to thereby return to the initial uppermost position.

Incidentally, in FIGS. 16(*a*) and 16(*b*), 63 designates an upright cylinder, i.e., an element for constituting an air pressure type operation cylinder mechanism 60. An axis 62 as a movable member in the invention corresponds to a piston axis of the operation cylinder mechanism 60, and a distal end of the axis is provided with a rod shape receiving table 61 having a horizontal rectangular section. 64 designates a throttle valve and 65 designates an electromagnetic valve, and both valves are members relating to introduction of air pressure into the cylinder 63. The electromagnetic valve 65 is connected to an air source, and original air pressure thereof is reduced to an appropriate air pressure through the throttle valve 64. Here, the throttle valve 64 has a safety valve function for a reduced pressure air, i.e. when the reduced pressure air exceeds a predetermined set point, the air is released into an atmosphere to keep the set point. 66 designates a limit switch for directly detecting the lowest position of the pushing axis 27 through a sensor piece 67 and indirectly detecting that the receiving table 61 reaches the lowermost position. Also, the limit switch 66 turns off the electromagnetic valve 65 as locking means through a control circuit 68 to thereby stop introduction of an air pressure into the cylinder 63. Further, the limit switch 66 turns on, i.e. releases, the electromagnetic valve 65 through the control circuit 68 based on a return command to thereby introduce the air pressure into the cylinder 63 (corresponding to the energizing means).

Therefore, operation of the first embodiment of the auxiliary pushing device is as follows. In FIG. 16(*a*), the pushing element 26A puts the food material 1 and the wrapping paper 9 together to be sandwiched between the receiving table 61 located at the uppermost position at the initial stage and the pushing element 26A, and then drives the receiving table 61 against the upward energizing force by the introduced air pressure based on opening of the electromagnetic valve 65 to thereby lower the food material 1 and the wrapping paper 9 along a guide 90. When the receiving table 61 reaches the lowermost position, the electromagnetic valve 65 is turned off through the limit switch 66 and the control circuit 68 to thereby complete pushing operation of the food material 1 and the wrapping paper 9. Then, the pushing member 26A ascends to return to the initial position, and the food material 1 and the wrapping paper 9, while keeping the condition folded by the receiving table 61 and the guide 90, are transferred to the next horizontal transfer process same as in the prior art, by a holding member 55 and a holding-and-transfer member 56 (refer to FIG. 22(*b*)). Thereafter, based on a return command, the electromagnetic valve 65 is turned on through the control circuit 68, and the receiving table 61 is elevated by introduction of air pressure into the cylinder 63 to thereby return to the uppermost position at the initial stage.

Operational steps of a first embodiment of the auxiliary pushing device are explained referring to FIGS. 17(*a*)–(*c*). FIG. 17(*a*) is a front view of the device before a pushing operation is performed, wherein the pushing member 26A is located at the initial stage position, the food material 1 is placed on an upper surface of the lower heating plate 21, and the wrapping paper 9 is placed on both horizontal edge portions of an upper portion of the guide 90. An this stage, the electromagnetic valve 65 is turned on and the receiving table 61 is located at the uppermost position to support the wrapping paper 9 from a lower side.

FIG. 17(*b*) is a front view of the device in the middle of the pushing operation, wherein the pushing member 26A descends to laminate the food material 1 and the wrapping paper 9, sandwiches them between the receiving table 61 and the pushing member 26A to prevent the food material 1 and the wrapping paper 9 from being deviated, and then further descends against an upward energizing force of the receiving table 61 while keeping the sandwiching state. Here, as the receiving table 61 descends, although a space of a lower portion in the cylinder 63 is compressed, the air pressure is held at the set value by the safety function of the throttle valve 64 (refer to FIG. 16(*a*)), so that the upward energizing force against the receiving table 61 is held constant.

FIG. 17(*c*) is a front view of the device after the pushing operation, wherein the food material 1 and the wrapping paper 9 sandwiched between the pushing member 26A and the receiving table 61 descend while being folded into a V-shape along the guide 90, and the pushing operation is completed when the receiving table 61 stops at the lowermost position. At this step, as mentioned above, the pushed food material 1 and the wrapping paper 9 can proceed to the next horizontal transfer process. Thereafter, based on a return command, the electromagnetic valve 65 (refer to FIG. 16(*a*)) is turned on, air pressure is introduced into the cylinder 63, and the receiving table 61 ascends to return to the uppermost position (FIG. 17(*a*)) at the initial stage.

Figures 18A, 18B:
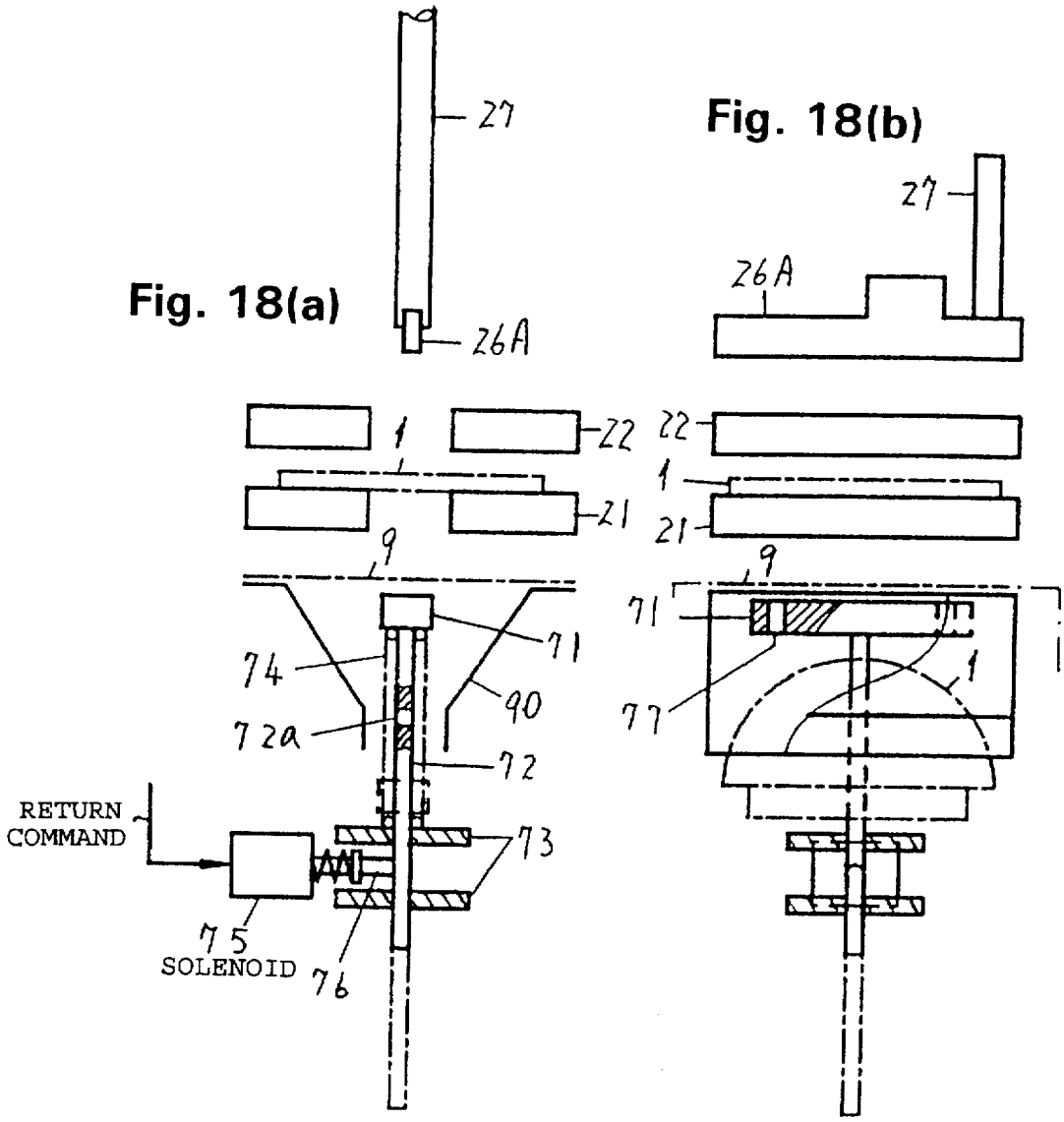
FIG. 18(*a*) is a front view of a second embodiment of an auxiliary pushing device.
Figure 23A:
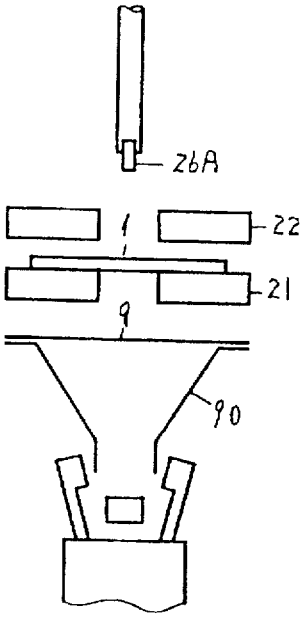
Fig. 23(a) Prior Art
FIGS. 23(*a*)–23(*c*) show operation steps of the conventional auxiliary pushing device, wherein FIG. 23(*a*) is a front view before a pushing operation, FIG. 23(*b*) is a front view in the middle of the pushing operation, and FIG. 23(*c*) is a front view after the pushing operation.
Figure 23B:
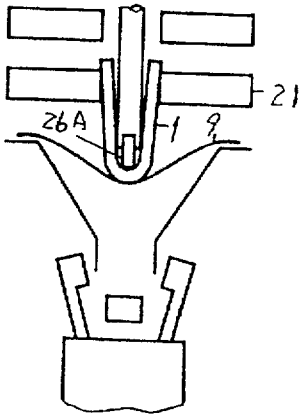
Fig. 23(b) Prior Art
Figure 23C:
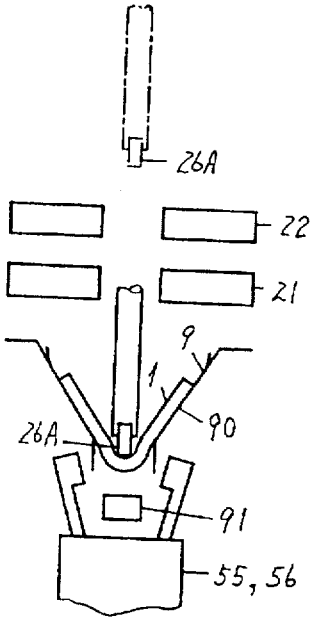
Fig. 23(c) Prior Art

A second embodiment of the auxiliary pushing device is explained referring to FIGS. 18(*a*) and 18(*b*). FIG. 18(*a*) is a front view of the device, and FIG. 18(*b*) is a side view thereof. The second embodiment of the auxiliary pushing device is same as the first embodiment in function thereof except for an additional function explained in the following, and is different only in construction. The additional function is that the receiving table absorbs the wrapping paper only at the initial stage, i.e., until the wrapping paper is sandwiched by the receiving table and the pushing member, to definitely prevent deviation of the wrapping paper at the initial stage. As to the construction, an axis 72 as a movable member in the invention is provided upright through a pair of upper and lower bearings 73, supported to be movable in an axial direction thereof, and provided with a receiving table 71 at an upper end thereof. The axis 72 is provided with a hole 72*a* passing through the axis 72 in a direction perpendicular to the axis near the upper end thereof, and energized upward through a compress coil type spring 74. Also, a rod shape engaging member 76 is driven in a horizontal direction by a solenoid 75, i.e., the rod shape engaging member 76 is driven to a left side when magnetically excited, and is energized to a right side by an unnumbered spring when not magnetically excited. A forward end of the rod shape engaging member 76 is adapted to be fitted into the hole 72*a* of the axis 72. Therefore, the engaging member 76 is fitted into the hole 72*a* to stop the axis 72, and released from the hole 72*a* by activation of the solenoid 75, so that the axis 72 depends on a energizing force of the spring 74. As shown in FIG. 18(*b*), the receiving table 71 has absorption holes 77 vertically passing therethrough in right and left portions thereof. The absorption holes 77 are connected to a vacuum pump through piping (not shown) to constitute a vacuum absorption portion to thereby absorb the wrapping paper 9 on the receiving table 71.

Operation steps of the second embodiment of the auxiliary pushing device are supplementally explained referring to FIGS. 19(*a*)–19(*c*). FIG. 19(*a*) is a front view of the device before a pushing operation is performed, wherein the pushing member 26A is located at an upper position of an initial stage, the food material 1 is placed on the upper surface of the lower heating plate 21, and the wrapping paper 9 is placed on both side horizontal portions of the upper end of the guide 90. At the same time, the receiving table 71 is located at the uppermost position to support the wrapping paper 9 from the lower side and absorbs the wrapping paper 9 through the absorption holes 77 (refer to FIG. 18(*b*)) to definitely prevent deviation of the wrapping paper at the initial stage.

FIG. 19(*b*) is a front view of the device in the middle of the pushing operation, wherein the pushing member 26A descends to sandwich the food material 1 and the wrapping paper 9 between the receiving table 71 and the pushing member 26A so as to prevent the deviation of the food material 1 and the wrapping paper 9, and further descends against the upward energizing force by the spring 74 of the receiving table 71 while holding the sandwiched state. At this moment, the axis 72 slidingly descends along the forward end of the engaging member 76 abutting against the periphery of the axis.

FIG. 19(*c*) is a front view of the device after the pushing operation, wherein the food material 1 and the wrapping paper 9 sandwiched between the pushing member 26A and the receiving table 71 descend while being folded into a V-shape along the guide 90, and at the lowermost position of the receiving table 71, the forward end of the engaging member 76 is fitted into the hole 72*a* to stop the axis 72 to thereby complete the pushing operation. Next, before returning the pushing member 26A to the initial position, as mentioned above, the horizontal transfer process as the next process can be started. Thereafter, based on a return command, the solenoid 75 is magnetically excited to drive the engaging member 76 to the left direction, the forward end of the engaging member 76 is released from the hole 72*a*, and the axis 72 depends on the energizing force of the spring 74, so that the receiving table 71 ascends to return to the uppermost position (FIG. 19(*a*)) at the initial stage.

A third embodiment of the auxiliary pushing device is explained hereunder referring to FIGS. 20(*a*) and 20(*b*). FIG. 20(*a*) is a front view of the device, and FIG. 20(*b*) is a side view thereof. In the third embodiment, the guide is formed of a pair of movable plates rotatably opening and closing, the movable plates are pushed downward to be a V-shape against the rotation energizing force when the food material and the wrapping paper are pushed, and the receiving table is provided at a fixed position. In FIG. 20(*a*), the guide 80 is formed of a pair of horizontal right and left axes 82 perpendicular to the paper surface in the drawing, movable plates 81 rotatably supported around the respective axes, and a return spring and a horizontal positioning stopper (not shown) disposed around the axes 82 for energizing the respective movable plates 81 toward closing positions shown by a horizontal solid line. Incidentally, the receiving table 91 is of a fixed position type same as in the prior art.

Operational steps of the third embodiment of the auxiliary pushing device is supplementally explained hereinafter referring to FIGS. 21(*a*)–21(*c*). FIG. 21(*a*) is a front view before a pushing operation, wherein the pushing member 26A is disposed at an upper position at an initial stage, the food material 1 is placed on an upper surface of the lower heating plate 21, and the wrapping paper 9 is placed on upper surfaces of the pair of right and left movable plates 81.

FIG. 21(*b*) is a front view of the device in the middle of the pushing operation, wherein the pushing member 26A descends to laminate the food material 1 and the wrapping paper 9 to push out, and according to the pushing operation, the respective movable plates 81 are opened against rotation energizing force of the return spring. Therefore, between the food material 1 and the wrapping paper 9, a friction resistance works based on the rotation energizing force on the right and left sides of the folding to thereby prevent mutual positional deviation.

FIG. 21(*c*) is a front view of the device after the pushing operation. As the pushing member 26A descends, the food material 1 and the wrapping paper 9 are folded into a V-shape by further opening the right and left movable plates against the rotation energizing force of the return spring, and are pushed against an upper surface of the receiving table 91 to thereby complete the pushing operation. Moreover, through all the pushing operation period, between the food material 1 and the wrapping paper 9, friction resistance works based on the rotation energizing force of the movable plates on the right and left sides of the folding to thereby prevent mutual deviation. After the pushing operation, as described above, the holding process for horizontally transferring the food material 1 and the wrapping paper 9 as the next process can be started. Then, the pushing member 26A ascends to return to the initial position, and after the process of transferring the food material 1 and the wrapping paper 9, the respective movable plates 81 return to the horizontal positions at the initial stage (refer to FIG. 21(*a*)) by the rotation energizing force.

According to the present invention, the following advantages can be obtained.

As to a food material transferring apparatus:

(1) The food material transferring apparatus is provided with a process assembly formed of a heating device, a pushing device and trays, and a bi-directional straight proceeding mechanism respectively located on one side and the other side as viewed from the front of the drawing, so that they are easily accessible. Also, since an arm provided with the hand can be detached from the bi-directional straight proceeding mechanism, operation and maintenance of the whole apparatus are facilitated.

(2) As a method for transferring food materials from the tray to the heating device, there are: (i) a first food material transfer system, wherein after the only food materials laminated to be stored on the tray are transferred in batch to a holding table near the heating device by beams of the hand carrying the food materials on upper surfaces thereof, the food materials are inserted into the heating device one by one through absorption pads of the hand; and (ii) a second food material transfer system, wherein after the food materials are transferred in a batch by the beams of the hand carrying the food materials on the supper surfaces thereof together with the tray to the holding table near the heating device, the food materials are inserted into the heating device one by one through the absorption pads of the hand, and upon completion, the tray is returned to an initial position. A food transfer time is greatly reduced by adopting one of the transfer systems. Especially in the second food material transfer system, although an operation for returning the tray is additionally required, there is no risk that the food materials collapse during the batch-transfer, and a structure of the holding table is simplified.

(3) The absorption pads comprise a plurality of units wherein one unit includes two pads, and the respective units are connected to different vacuum pumps, so that even if one vacuum pump is out of order, reliability of absorption holding is improved. Also, even if a food material is accidentally dropped out from the hand during transfer, the food material is received by a receiving plate to be stored, the operation reliability is improved.

(4) The heating device is surrounded by insulation side walls except for a food material inlet, and the food material inlet is vertically moved and opened and closed by a movable insulation door integrally formed with an upper heating plate only at a time of insertion of the food material, so that insulation effect thereof is improved, i.e. heat radiation from the upper and lower heating plates is suppressed, heat is effectively used, and heat does not affect other units in the apparatus.

(5) According to embodiments, a pushing member for pushing a food material while folding the food material into a V-shape and a simple detachable mechanism of the pushing member are adopted, so that the pushing member is easily exchanged in a small space of the heating device, and operation and maintenance thereof are facilitated.

As to a deviation quantity detecting device:

(1) A deviation quantity is detected accurately and quickly without touching in a straight proceeding step of the hand. Naturally, the positioning can be corrected based on the detected deviation quantity.

(2) Instead of a distance of the hand, by applying a time interval, a time-measuring device (a clock or a timer), which is simpler in construction and easier in operation than a displacement sensor, can be used.

As to an auxiliary pushing device:

(1) A food material and a wrapping paper are laminated from an initial stage to be sandwiched between a pushing member and a receiving plate and pushed while being folded along a guide, so that although there is a possibility of deviation caused between the food material and the wrapping paper during the pushing process, the deviation is prevented; eventually, a quality of food material wrapping can be improved. Especially, since the auxiliary pushing device is formed of either an air pressure type operation cylinder, or a system including a movable member, a spring and an engaging member, depending on election of the structures, more appropriate designs suitable for surrounding conditions can be made.

(2) Since the receiving table can hold a wrapping material by a vacuum absorption portion on the upper surface thereof, at the initial stage, a possibility of deviation of the wrapping material can be surely eliminated, and deviation between the food material and the wrapping paper can be prevented.

(3) In case there is employed a system where a pair of rotatably closable type movable plates as a guide is used, and the movable plates are pushed to be opened into a V-shape against an energizing force in a course of pushing the food material and the wrapping paper, the receiving table is located at a fixed position to simplify the structure, and friction resistance acts between the food material and the wrapping material based on the energizing force of the movable plates at the time of pushing operation, so that deviation between the food material and the wrapping paper is prevented; eventually, a quality of food material wrapping can be improved.

What is claimed is:

1. A food material transferring apparatus for transferring soft food materials, comprising:

at least one tray for vertically storing soft food materials, said tray having a base plate with a slit, and a side wall for supporting the food material disposed on the base, a heating device for heating the food material when the food material is inserted thereinto, a pushing member situated above the heating device and being movable in a vertical direction, said pushing member being moved downwardly after the food material is heated in the heating device so that the food material in the heating device is folded and pushed out from the heating device, an arm having a hand formed at one side of the arm, said hand being formed of a horizontal beam for holding the food material and having absorption pads under the beam for vacuum-absorbing the food material, said horizontal beam having a size to pass vertically through the slit, a moving mechanism movable in vertical and lateral directions, said moving mechanism being situated adjacent to the tray and the heating device and fixed at the other side of the arm, said moving mechanism being moved so that the hand takes the food material and transfers the food material into the heating device, and a holding table for temporarily holding the food materials thereon, said holding table having a slit and being situated near the heating device so that when the arm is actuated by the moving mechanism, the beam passes through the slit of the tray, holds the food materials thereon and transfers the same to the holding table, said beam passing through the slit of the holding table for further processing after disposing the food materials on the holding table.

2. A food material transferring apparatus according to claim 1, wherein said moving mechanism is a two direction straight proceeding mechanism, said apparatus further including a receiving plate disposed under the heating device for covering a processing area of the hand, said receiving plate receiving the food material which is dropped.

3. A food material transferring apparatus according to claim 1, wherein the absorption pads are formed of at least one pair of pads to correspond to both end portions of the food material.

4. A food material transferring apparatus according to claim 3, wherein said absorption pad is formed of a plurality of pairs of pads, said pairs being respectively connected to different vacuum pumps.

5. A food material transferring apparatus according to claim 1, wherein said heating device is formed of a stationary lower heat plate, an upper heat plate situated above the lower plate and being movable in a vertical direction, an inlet situated between the upper and lower heat plates, a stationary insulation side wall surrounding the lower and upper heat plates except the inlet, and a movable insulation door attached to the upper heat plate, said movable insulation door opening and closing the inlet according to ascending and descending of the upper heat plate.

6. A food material transferring apparatus for transferring soft food materials, comprising:

at least one tray for vertically storing soft food materials, a heating device for heating the food material when the food material is inserted thereinto, a pushing member situated above the heating device and being movable in a vertical direction, said pushing member being moved downwardly after the food material is heated in the heating device so that the food material in the heating device is folded and pushed out from the heating device, an arm having a hand formed at one side of the arm, said hand having a horizontal beam and absorption pads under the beam for vacuum-absorbing the food material, a moving mechanism movable in vertical and lateral directions, said moving mechanism being situated adjacent to the tray and the heating device and fixed at the other side of the arm, said moving mechanism being moved so that the hand takes the food material in the tray and transfers the food material into the heating device, and a holding table for temporarily holding the tray with the food materials thereon, said holding table being situated near the heating device and having a slit so that when the arm is actuated by the moving mechanism, the beam supports the tray with the food materials thereon and transfers the same to the holding table, said beam passing through the slit for further processing after disposing the tray on the holding table.

7. A food material transferring apparatus according to claim 6, wherein said hand includes a positioning member for holding the tray disposed above the beam.

8. A food material transferring apparatus for transferring soft food materials, comprising:

at least one tray for vertically storing soft food materials, a heating device for heating the food material when the food material is inserted thereinto, a pushing member situated above the heating device and being movable in a vertical direction, said pushing member being moved downwardly after the food material is heated in the heating device so that the food material in the heating device is folded and pushed out from the heating device, an arm having a hand formed at one side of the arm, said hand having absorption pads for vacuum-absorbing the food material, a moving mechanism movable in vertical and lateral directions, said moving mechanism being situated adjacent to the tray and the heating device and fixed at the other side of the arm, said moving mechanism being moved so that the hand takes the food material in the tray and transfers the food material into the heating device, a deviation degree detecting device for detecting a deviation degree in a straight processing direction between a center of the hand and a center of the food material held by the hand when the hand holding the food material is moved, the straight processing direction being on a line between the center of the hand and a fixed point on the hand at a predetermined distance away from the center, said detecting device including a sensor disposed on a line of the straight processing direction and outputting signals when a fixed point on the hand, a first point on a contour of the food material located near the fixed point and a second point on the contour of the food material located away from the fixed point pass, and a deviation computing section for computing the deviation degree based on the signals from the sensor.

9. A food material transferring apparatus according to claim 8, wherein the deviation computing section includes distance-measuring means for obtaining a first distance between the fixed point and the first point and a second distance between the fixed point and the second point based on the signals from the sensor, and a computing part for computing the deviation degree from the first and second distances obtained by the distance-measuring means.

10. A food material transferring apparatus according to claim 8, wherein the deviation computing section includes time-measuring means for obtaining a first time period between the fixed point and the first point and a second time period between the fixed point and the second point, and a computing part for computing the deviation degree from the first and second time periods obtained by the time-measuring means and a predetermined speed of the hand.

11. A food material transferring apparatus for transferring soft food materials, comprising:

at least one tray for vertically storing soft food materials, a heating device for heating the food material when the food material is inserted thereinto, a pushing member situated above the heating device and being movable in a vertical direction, said pushing member being moved downwardly after the food material is heated in the heating device so that the food material in the heating device is folded and pushed out from the heating device, an arm having a hand formed at one side of the arm, said hand having absorption pads for vacuum-absorbing the food material, a moving mechanism movable in vertical and lateral directions, said moving mechanism being situated adjacent to the tray and the heating device and fixed at the other side of the arm, said moving mechanism being moved so that the hand takes the food material in the tray and transfers the food material into the heating device, means for providing a wrapping material disposed under the heating device, a horizontal receiving table situated under the means for providing the wrapping material, a movable member attached at an upper end to the receiving table and being movable in a vertical direction between upper and lower limits, actuating means attached to a lower end of the movable member for urging the movable member upwardly, and lock means for locking the movable member at the lower limit, said pushing member, when actuated, pushing the food material in the heating device, laminating the food material with the wrapping material for folding into a V-shape along a guide, and placing the folded food material with the wrapping material on the receiving table.

12. A food material transferring apparatus according to claim 11, wherein the movable member, the actuating means and the lock means constitute an air pressure type cylinder system, and respectively correspond to a piston axis, an air pressure cylinder for the piston, and a valve for opening and closing air to the cylinder.

13. A food material transferring apparatus according to claim 11, wherein the actuating means is a spring, and the lock means is a stopper for stopping and releasing the movable member.

14. A food material transferring apparatus according to claim 11, wherein the receiving table includes a vacuum absorption part to hold the wrapping material on an upper surface thereof.

15. A food material transferring apparatus for transferring soft food materials, comprising:

at least one tray for vertically storing soft food materials, a heating device for heating the food material when the food material is inserted thereinto, a pushing member situated above the heating device and being movable in a vertical direction, said pushing member being moved downwardly after the food material is heated in the heating device so that the food material in the heating device is folded and pushed out from the heating device, an arm having a hand formed at one side of the arm, said hand having absorption pads for vacuum-absorbing the food material, a moving mechanism movable in vertical and lateral directions, said moving mechanism being situated adjacent to the tray and the heating device and fixed at the other side of the arm, said moving mechanism being moved so that the hand takes the food material in the tray and transfers the food material into the heating device, means for providing a wrapping material disposed under the heating device, a horizontal receiving table situated under the means for providing the wrapping material, and a pair of rotatable plates situated between the receiving table and the means for providing the wrapping material and forming a guide, said rotatable plates being opened and closed and having axes located parallel to each other and disposed at an equal distance away from each side surface of the pushing member, said movable plates being movable around the respective axes and activated toward a closed position at an early stage, said pushing member, when actuated, pushing the food material in the heating device, laminating the food material with the wrapping material placed on the rotatable plates at the closed position, pushing the food material and the wrapping material while folding into a V-shape and opening the rotatable plates, and placing the folded food material with the wrapping material on the receiving table.

* * * * *

UNITED STATES PATENT AND TRADEMARK OFFICE

CERTIFICATE OF CORRECTION

PATENT NO. : 5,699,655

DATED : December 23, 1997

Figure 4B:
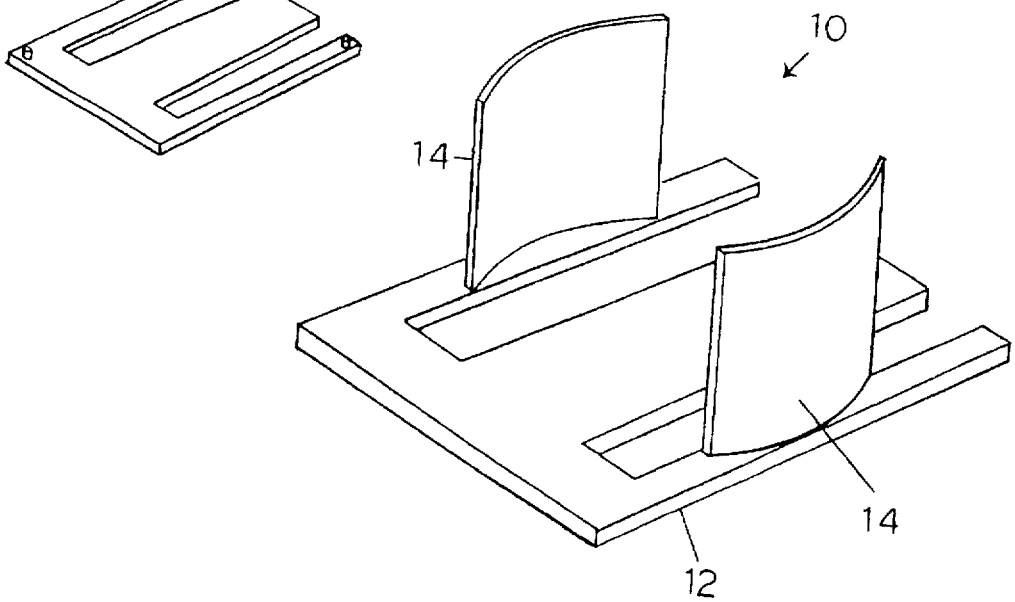

INVENTOR(S) : Kimimasa Kuboyama, Shoji Yokoyama, Yoshinori Miyakoshi, Hiroya Taniguchi, Kazuhiro Tsuruta, Hisashi Goto It is certified that error appears in the above-identified patent and that said Letters Patent is hereby corrected as shown below:

In column 4, line 66, change "comprises" to --comprise--;

In column 9, line 50, change "FIG. 4" to --FIG. 4(b)--;

In column 11, line 48, delete "34, in";
line 49, change "total, r" to --beams 33 and four--;

In column 12, line 57, change "27ais" to --27a is--;
line 59, change "27ais" to --27a is--;

In column 13, line 38, change "a flow chart of" to --a diagram of--;

In column 16, line 44, change "bushing" to --pushing--;

In column 17, line 57, change "An" to --At--;

In column 18, line 49, change "a" to --an--;

UNITED STATES PATENT AND TRADEMARK OFFICE

CERTIFICATE OF CORRECTION

PATENT NO. : 5,699,655

DATED : December 23, 1997

INVENTOR(S) : Kimimasa Kuboyama, Shoji Yokoyama, Yoshinori Miyakoshi, Hiroya Taniguchi, Kazuhiro Tsuruta, Hisashi Goto It is certified that error appears in the above-identified patent and that said Letters Patent is hereby corrected as shown below:

In column 20, line 43, change "supper" to --upper--; and line 62, add after comma --so that--.

Signed and Sealed this

Twelfth Day of May, 1998

Bruce Lehman

*Attest:*

BRUCE LEHMAN

*Attesting Officer*

*Commissioner of Patents and Trademarks*